US007806294B2

(12) United States Patent
Gatipon et al.

(10) Patent No.: US 7,806,294 B2
(45) Date of Patent: Oct. 5, 2010

(54) SYSTEMS AND METHODS FOR DISPENSING FLAVOR DOSES AND BLENDED BEVERAGES

(75) Inventors: Shaun B. Gatipon, Kennesaw, GA (US); Douglas Jon McDougall, Atlanta, GA (US); Byron L. Eberhart, III, Duluth, GA (US); Thomas R. Hecht, Winters, CA (US); Roland E. Young, Fair Oaks, CA (US); Richard A. Martindale, Vacaville, CA (US); Bret D. Baker, Vacaville, CA (US)

(73) Assignee: The Coca-Cola Company, Atlanta, GA (US)

( * ) Notice: Subject to any disclaimer, the term of this patent is extended or adjusted under 35 U.S.C. 154(b) by 731 days.

(21) Appl. No.: 11/557,069

(22) Filed: Nov. 6, 2006

(65) Prior Publication Data

US 2007/0114244 A1 May 24, 2007

Related U.S. Application Data

(60) Provisional application No. 60/734,020, filed on Nov. 4, 2005.

(51) Int. Cl.
*B67B 7/00* (2006.01)

(52) U.S. Cl. ..... 222/1; 222/129.4

(58) Field of Classification Search ..... 222/129.1, 222/129.3, 129.4; 700/233, 239; 99/280
See application file for complete search history.

(56) References Cited

U.S. PATENT DOCUMENTS 3,991,911 A 11/1976 Shannon et al.

(Continued)

FOREIGN PATENT DOCUMENTS

BE 1005369 A6 7/1993

(Continued)

OTHER PUBLICATIONS

Automatic Bar Controls, Inc. (d/b/a Wunder-Bar). "Listing of Relevant Wunder-Bar Products and Product Parts."

(Continued)

*Primary Examiner*—Kevin P Shaver
*Assistant Examiner*—Daniel R Shearer
(74) *Attorney, Agent, or Firm*—Sutherland, Asbill & Brennan LLP

(57) ABSTRACT

Disclosed are systems and methods for dispensing flavor doses and beverages. A beverage tower may be provided that has a small footprint and that is capable of dispensing a wide variety of flavor doses and blended beverages. The beverage tower may include a flow control module that controls the flow rate of beverage additives and water through the beverage tower and a switch module that includes a plurality of switches that may be selectively opened and closed to control the flow of beverage additives and water through the beverage tower to a point of dispense. A flavor dose or blended beverage may be dispensed by the beverage tower in accordance with user input that is provided to the beverage tower via a control panel. The user input may specify a desired beverage additive, a desired cup size, and an indication of whether a flavor shot or a blended beverage is desired. Additionally, a user may define and program into the memory of the beverage tower the various flavor doses and blended beverages that are capable of being dispensed by the beverage tower.

22 Claims, 19 Drawing Sheets

U.S. PATENT DOCUMENTS

| | | | | |
|---|---|---|---|---|
| 4,732,300 | A | 3/1988 | Valiyee et al. | |
| 4,979,639 | A * | 12/1990 | Hoover et al. | 222/1 |
| 5,000,357 | A * | 3/1991 | Shannon et al. | 222/129.1 |
| 5,042,692 | A | 8/1991 | Valiyee et al. | |
| 5,058,780 | A | 10/1991 | Plester et al. | |
| 5,299,715 | A | 4/1994 | Feldman | |
| 5,379,916 | A | 1/1995 | Martindale et al. | |
| 5,803,320 | A | 9/1998 | Cutting et al. | |
| 6,196,422 | B1 | 3/2001 | Tuyls et al. | |
| 6,260,477 | B1 | 7/2001 | Tuyls et al. | |
| 6,269,973 | B1 | 8/2001 | Bennett et al. | |
| 6,345,729 | B1 * | 2/2002 | Santy, Jr. | 222/1 |
| 6,452,514 | B1 * | 9/2002 | Philipp | 341/33 |
| 6,832,487 | B1 | 12/2004 | Baker | |
| 7,337,920 | B2 * | 3/2008 | Duck et al. | 222/63 |
| 7,445,133 | B2 * | 11/2008 | Ludovissie et al. | 222/145.5 |
| 2004/0118872 | A1 * | 6/2004 | Romanyszyn et al. | 222/129.1 |
| 2004/0217129 | A1 | 11/2004 | Roekens et al. | |
| 2005/0188854 | A1 | 9/2005 | Green et al. | |

FOREIGN PATENT DOCUMENTS

| | | | |
|---|---|---|---|
| GB | 2101088 | A | 1/1983 |
| WO | 9014303 | A1 | 11/1990 |

OTHER PUBLICATIONS

Automatic Bar Controls, Inc., "Calibration and Start-up Instructions for the Baskin Robbins Dispenser," Dec. 31, 1998.

Automatic Bar Controls, Inc., "Instructions for a 10 Product Portion Controlled Mini Tower," Nov. 2, 2001.

Automatic Bar Controls, Inc., "Wunder-Bar System III Liquor Control Installation Manual," Feb. 5, 1992.

Automatic Bar Controls, Inc., "Instructions for Post-Mix Juice Dispensing Systems," Sep. 28, 2001.

General Dispensers, "Advertisement for Dispenser Models."

* cited by examiner

First Default Settings

| Flavor Key | Ratio | Shot Size Increment (oz) | Beverage Lockout |
|---|---|---|---|
| A | 5.00:1 | 0.5 | No |
| B | 4.00:1 | 0.5 | No |
| C | 4.00.1 | 0.5 | No |
| D | 5.00:1 | 0.25 | Yes |
| E | 5.00:1 | 0.25 | Yes |
| F | 5.00:1 | 0.5 | No |
| G | 5.50:1 | 0.5 | No |
| H | 5.00:1 | 0.25 | Yes |

Fig. 14A

Second Default Settings

| Flavor Key | Ratio | Shot Size Increment (oz) | Beverage Lockout |
|---|---|---|---|
| A | 5.00:1 | 0.25 | No |
| B | 5.00:1 | 0.25 | No |
| C | 5.00:1 | 0.25 | No |
| D | 5.00:1 | 0.25 | No |
| E | 5.00:1 | 0.25 | No |
| F | 5.00:1 | 0.25 | No |
| G | 5.00:1 | 0.25 | No |
| H | 5.00:1 | 0.25 | No |

Fig. 14B

Portion Control Settings in Seconds
Beverage Table

| Oz Target | 9 | 12.15 | 17.55 | 23.85 |
|---|---|---|---|---|
| Ratio/Size | Small | Medium | Large | X-Large |
| 4.00:1 | 2.88 | 3.89 | 5.62 | 7.63 |
| 4.25:1 | 2.91 | 3.93 | 5.68 | 7.72 |
| 4.50:1 | 2.95 | 3.98 | 5.74 | 7.81 |
| 4.75:1 | 2.97 | 4.01 | 5.80 | 7.88 |
| 5.00:1 | 3.00 | 4.05 | 5.85 | 7.95 |
| 5.25:1 | 3.02 | 4.08 | 5.90 | 8.01 |
| 5.50:1 | 3.05 | 4.11 | 5.94 | 8.07 |
| 6.00:1 | 3.09 | 4.17 | 6.02 | 8.18 |

Fig. 15A

1/4 oz Flavor Shot Increment

| Oz Target | 0.25 | 0.50 | 0.75 | 1.00 |
|---|---|---|---|---|
| Ratio/Size | Small | Medium | Large | X-Large |
| 4.00:1 | 0.40 | 0.80 | 1.20 | 1.60 |
| 4.25:1 | 0.43 | 0.85 | 1.28 | 1.70 |
| 4.50:1 | 0.45 | 0.90 | 1.35 | 1.80 |
| 4.75:1 | 0.48 | 0.95 | 1.43 | 1.90 |
| 5.00:1 | 0.50 | 1.00 | 1.50 | 2.00 |
| 5.25:1 | 0.53 | 1.05 | 1.58 | 2.10 |
| 5.50:1 | 0.55 | 1.10 | 1.65 | 2.20 |
| 6.00:1 | 0.60 | 1.20 | 1.80 | 2.40 |

Fig. 15B

1/3 oz Flavor Shot Increment

| Oz Target | 0.33 | 0.67 | 1.00 | 1.33 |
|---|---|---|---|---|
| Ratio/Size | Small | Medium | Large | X-Large |
| 4.00:1 | 0.53 | 1.06 | 1.60 | 2.13 |
| 4.25:1 | 0.56 | 1.12 | 1.70 | 2.26 |
| 4.50:1 | 0.59 | 1.19 | 1.80 | 2.39 |
| 4.75:1 | 0.63 | 1.25 | 1.90 | 2.53 |
| 5.00:1 | 0.66 | 1.32 | 2.00 | 2.66 |
| 5.25:1 | 0.69 | 1.39 | 2.10 | 2.79 |
| 5.50:1 | 0.73 | 1.45 | 2.20 | 2.93 |
| 6.00:1 | 0.79 | 1.58 | 2.40 | 3.19 |

Fig. 15C

1/2 oz Flavor Shot Increment

| Oz Target | 0.50 | 1.00 | 1.50 | 2.00 |
|---|---|---|---|---|
| Ratio/Size | Small | Medium | Large | X-Large |
| 4.00:1 | 0.80 | 1.60 | 2.40 | 3.20 |
| 4.25:1 | 0.85 | 1.70 | 2.55 | 3.40 |
| 4.50:1 | 0.90 | 1.80 | 2.70 | 3.60 |
| 4.75:1 | 0.95 | 1.90 | 2.85 | 3.80 |
| 5.00:1 | 1.00 | 2.00 | 3.00 | 4.00 |
| 5.25:1 | 1.05 | 2.10 | 3.15 | 4.20 |
| 5.50:1 | 1.10 | 2.20 | 3.30 | 4.40 |
| 6.00:1 | 1.20 | 2.40 | 3.60 | 4.80 |

Fig. 15D

2/3 oz Flavor Shot Increment

| Oz Target | 0.67 | 1.33 | 2.00 | 2.67 |
|---|---|---|---|---|
| Ratio/Size | Small | Medium | Large | X-Large |
| 4.00:1 | 1.07 | 2.13 | 3.20 | 4.27 |
| 4.25:1 | 1.14 | 2.26 | 3.40 | 4.54 |
| 4.50:1 | 1.21 | 2.39 | 3.60 | 4.81 |
| 4.75:1 | 1.27 | 2.53 | 3.80 | 5.07 |
| 5.00:1 | 1.34 | 2.66 | 4.00 | 5.34 |
| 5.25:1 | 1.41 | 2.79 | 4.20 | 5.61 |
| 5.50:1 | 1.47 | 2.93 | 4.40 | 5.87 |
| 6.00:1 | 1.61 | 3.19 | 4.80 | 6.41 |

Fig. 15E

SYSTEMS AND METHODS FOR DISPENSING FLAVOR DOSES AND BLENDED BEVERAGES

RELATED APPLICATIONS

This application claims priority from U.S. Provisional Application No. 60/734,020, entitled "Methods and Systems for Dispensing Flavor Doses and Beverages," which was filed on Nov. 4, 2005, which is incorporated herein by reference in its entirety.

FIELD OF THE INVENTION

The present invention relates generally to a beverage dispenser, and more particularly, to systems and methods for providing both flavor doses and beverages.

BACKGROUND OF THE INVENTION

A number of beverage dispensers are well known in the art. These include carbonated beverage dispensers, non-carbonated beverage dispensers, beverage brewing systems, and liquor distribution systems. Some dispensers simply distribute a pre-mixed beverage that is supplied from behind the scenes storage tanks or bags. Other dispensers mix a beverage concentrate with water in a predetermined ratio in order to produce a finished product. These two types of dispensers, however, are generally limited to dispensing a mixed or blended beverage.

There are other dispensers that only dispense a flavor dose that can be added to an already existing beverage. The volume of the flavor dose may be automatically measured out by the dispenser, such as with a manual pump that produces a known volume each actuation, or the volume flavor dose may be based on user experience or skill, as with a squeeze bottle. These dispensers, however, are generally limited to dispensing a concentrated flavor shot.

Accordingly, there is a need in the art for an improved beverage and flavor dose dispenser.

SUMMARY OF THE INVENTION

Disclosed are systems and methods for dispensing flavor doses and beverages. A beverage tower may be provided that has a small footprint and that is capable of dispensing a wide variety of flavor doses and blended beverages. The beverage tower may include a flow control module that controls the flow rate of beverage additives and water through the beverage tower and a switch module that includes a plurality of switches that may be selectively opened and closed to control the flow of beverage additives and water through the beverage tower to a point of dispense. A flavor dose or blended beverage may be dispensed by the beverage tower in accordance with user input that is provided to the beverage tower via a control panel. The user input may specify a desired beverage additive, a desired cup size, and an indication of whether a flavor shot or a blended beverage is desired. Additionally, a user may define and program into the memory of the beverage tower the various flavor doses and blended beverages that are capable of being dispensed by the beverage tower.

According to an embodiment of the present invention, a beverage dispenser includes a flow control module that is configured to be coupled to a plurality of incoming supply lines carrying water and at least one beverage additive, and the flow control module provides individual channels through which the water and beverage additive pass at a controlled flow rate. A switch module is then configured to receive the water and beverage additive from the flow control module, and the switch module provides individual channels through which the water and beverage additive respectively pass, the switch module comprising a switch associated with each of the channels through which the water and beverage additive pass that may be selectively actuated to individually control the flow of the water and beverage additive through the switch module. A nozzle is configured to receive the water and beverage additive downstream from the switch module and provide individual channels through which the water and syrup are dispensed. A control panel is configured to receive user selection of a mixed beverage or a beverage additive, and a control unit coupled to the control panel and the switch module selectively actuates each switch based on the user input received by the control panel.

According to another embodiment of the present invention, a method for dispensing beverage additives and beverages is disclosed. Water and at least one beverage additive is received from a plurality of incoming supply lines. The flow of the received water and beverage additive is controlled with a flow rate device and individually actuatable switch associated with each incoming supply line. User input on the selection of a blended beverage is then received and predetermined amounts of the water and beverage additive are dispensed based on the user input by selectively actuating at least one of the switches associated with the water and the beverage additive associated with the selected blended beverage. Additionally, user input on the selection of a beverage additive is received and a predetermined amount of the beverage additive is dispensed based on the user input by selectively actuating at least one of the switches associated with the selected beverage additive.

Various aspects of the present invention may be applicable to both a beverage dispenser and a method for dispensing beverage additives and beverages. According to an aspect of the present invention, the control panel is further configured to receive a size selection from the user. The control panel may further include a removable selection card that depicts one or more user input options. The removable selection card may be a mylar card. The control panel further comprises a top off selection, wherein the top off selection will dispense an additional amount of the last blended beverage dispensed by the beverage tower when selected. According to another aspect of the present invention, the control panel comprises a plurality of coupling capacitor sensing elements configured to received user input. User input is received by the control panel without the user making physical contact with the control panel. According to yet another aspect of the present invention, the control unit further comprises a memory configured to store a plurality of beverage additive shot sizes and a plurality of ratios associated with the different size selections provided by the control panel, wherein the plurality of ratios define the amount of beverage additive to be mixed with a predetermined amount of water for each blended beverage dispensed by the beverage dispenser. The beverage additive shot sizes and ratios can be reprogrammed to new beverage additive shot sizes and ratios. The memory is further configured to store a plurality of beverage additives and an indication as to whether a blended beverage may be dispensed for each of the plurality of beverage additives. The memory further includes historical data relating to the use of the beverage dispenser and default settings that define flavor shot sizes and ratios of a plurality of flavor shots and blended beverages.

According to another aspect of the present invention, the switch module is comprised of a unitary block defining the individual channels and configured for securely coupling to the switch associated with each of the individual channels. According to another aspect of the present invention, the nozzle comprises a plurality of injectors configured to dispense the beverage additive received by the nozzle, wherein the plurality of injectors further comprise a mouth formed in a concave manner extending upwardly into the plurality of injectors. The nozzle further comprises a plurality of dispensers and a nozzle cap configured to direct the flow of water dispensed from said dispensers such that the dispensed water mixes with a beverage additive dispensed by the nozzle at a point below the nozzle in order to form a blended beverage. The brix ratio of a blended beverage dispensed by the beverage dispenser does not vary by more than approximately one degree throughout the blended beverage.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 1:
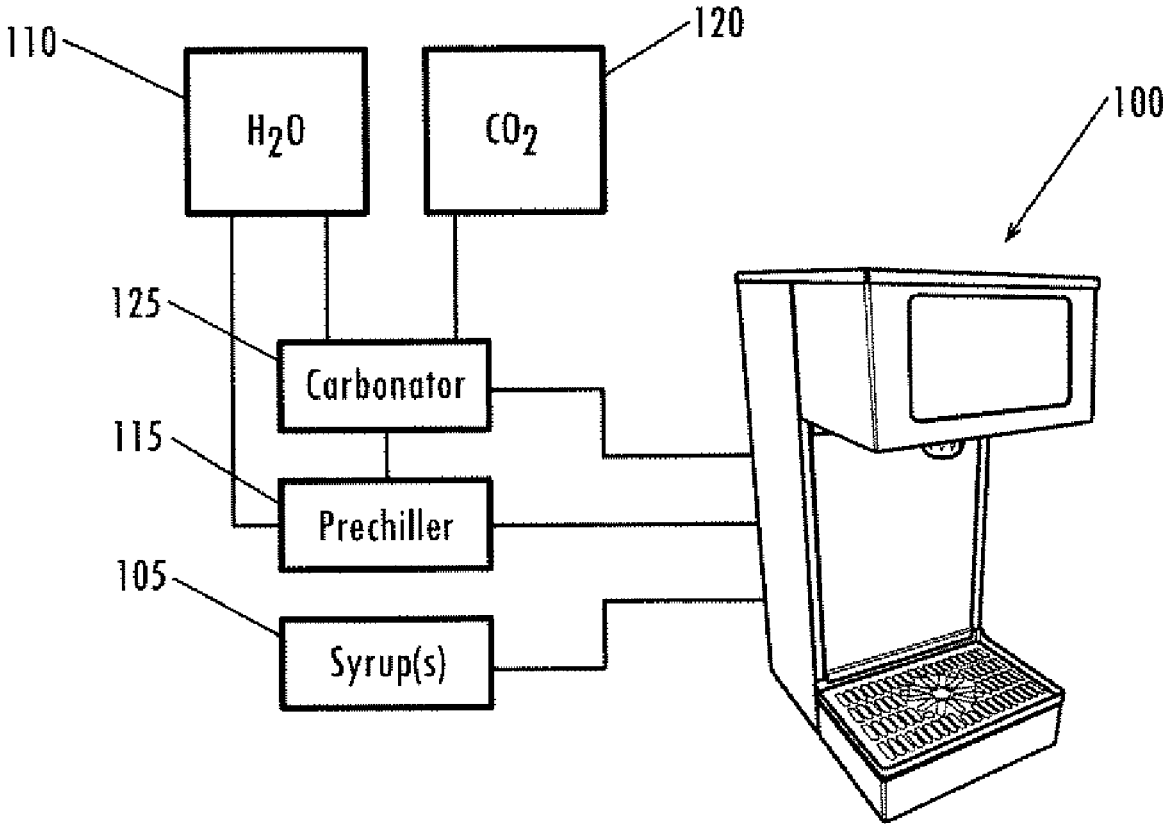
FIG. 1 illustrates an exemplary setup of a beverage tower according to an illustrative embodiment of the present invention.

FIGS. 14A-B are tables depicting the characteristics of the first and second default setting of a beverage tower, according to an illustrative embodiment of the present invention.

FIGS. 15A-E are tables depicting lengths of time that a solenoid needs to remain open in order to dispense a flavor shot or blended beverage from the beverage tower for various cup sizes and ratios of flavor syrup to cup size, according to an illustrative embodiment of the present invention.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The present invention is described below with reference to block diagrams of systems, methods, apparatuses and computer program products according to an embodiment of the invention. It will be understood that each block of the block diagrams, and combinations of blocks in the block diagrams, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create means for implementing the functionality of each block of the block diagrams, or combinations of blocks in the block diagrams discussed in detail in the descriptions below.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the block or blocks.

Accordingly, blocks of the block diagrams support combinations of means for performing the specified functions, combinations of steps for performing the specified functions and program instruction means for performing the specified functions. It will also be understood that each block of the block diagrams, and combinations of blocks in the block diagrams, can be implemented by special purpose hardware-based computer systems that perform the specified functions or steps, or combinations of special purpose hardware and computer instructions.

The inventions may be implemented through an application program running on an operating system of a computer. The inventions also may be practiced with other computer system configurations, including hand-held devices, multiprocessor systems, microprocessor based or programmable consumer electronics, mini-computers, mainframe computers, etc.

Application programs that are components of the invention may include routines, programs, components, data structures, etc. that implement certain abstract data types, perform certain tasks, actions, or tasks. In a distributed computing environment, the application program (in whole or in part) may be located in local memory, or in other storage. In addition, or in the alternative, the application program (in whole or in part) may be located in remote memory or in storage to allow for the practice of the inventions where tasks are performed by remote processing devices linked through a communications network. Exemplary embodiments of the present invention will hereinafter be described with reference to the figures, in which like numerals indicate like elements throughout the several drawings.

With reference to FIG. 1, an exemplary setup of a beverage tower 100 in accordance with the present invention is shown. The beverage tower 100 may be implemented in a wide variety of settings such as, for example, in a restaurant. As shown in FIG. 1, the beverage tower 100 may be configured to receive both flavor syrups 105 and water ($H_2O$) 110. It will be understood that a beverage tower 100 in accordance with the present invention may be capable of receiving many different types of flavorings and/or beverage additives including such as, for example, tea flavorings, coffee flavorings, vitamin shots, sweetener shots, etc. For purposes of the present disclosure, one ore more flavor syrups 105 are provided to the beverage tower 100. The one or more flavor syrups 105 may be supplied to the beverage tower 100 by input tubing, as explained in greater detail below with reference to FIG. 2. The one or more flavor syrups 105 may further be supplied from a bag-in-box system, as will be understood by those of ordinary skill in the art.

Water 110 supplied to the beverage tower 100 may be supplied from any water source through input tubing, as explained in greater detail below with reference to FIG. 2. The water 110 may be circulated through a prechiller 115 before it is supplied to the beverage tower 100. It will be understood that the prechiller 115 may be any suitable device for lowering the temperature of the water 110 supplied to the beverage tower 100. Additionally, the prechiller 115 may be incorporated into the beverage tower 100 or, alternatively, the prechiller 115 may be a separate device. The beverage tower 100 may be configured to receive non-carbonated and/or carbonated water. In order to receive carbonated water, the water 110 supplied to the beverage tower 100 may have carbon dioxide ($CO_2$) 120 added to it by a carbonator 125. The carbonator 125 may be any suitable device that is capable of dissolving carbon dioxide 120 in water 110 or any other liquid or aqueous solution. Carbonated water may be supplied directly to the beverage tower 100 by the carbonator 125 or, alternatively, the carbonated water may be circulated through a prechiller 115 before it is supplied to the beverage tower 100. It will be understood that the water 110 may additionally or alternatively be circulated through a prechiller 115 before it is supplied to the carbonator 125. It will also be understood that the carbonator 125 may be incorporated into the beverage tower 100 or, alternatively, the carbonator 125 may be a separate device. For purposes of illustrating the present invention, both carbonated and non-carbonated water are illustrated in FIG. 1 as being supplied to the beverage tower 100. However, it will be appreciated that according to the present invention, both carbonated and non-carbonated water are not required.

According to an aspect of the present invention, the beverage tower 100 may be capable of dispensing one or more flavor syrups 105 that can be used in the making of beverages. The beverage tower 100 may also be capable of dispensing a blended beverage by mixing one or more flavor syrups 105 with water 110. Additionally, the beverage tower 100 may be capable of dispensing carbonated beverages by adding carbon dioxide 120 to a beverage or by incorporating carbonated water into beverages. It will be understood by those skilled in the art that the beverage tower 100 can be implemented in such a way as to be capable of dispensing many different types of flavorings, flavored beverages, and blended beverages. For instance, different tea flavorings may be provided to the beverage tower 100 in order to create a variety of blended tea beverages. The beverage tower 100 may be utilized to dispense various flavorings and beverages including but not limited to water, tea, coffee, juices, energy drinks, vitamin-fortified beverages, high fructose corn syrup beverages, sucrolose or diet beverages, and aspartame beverages.

Figure 2:
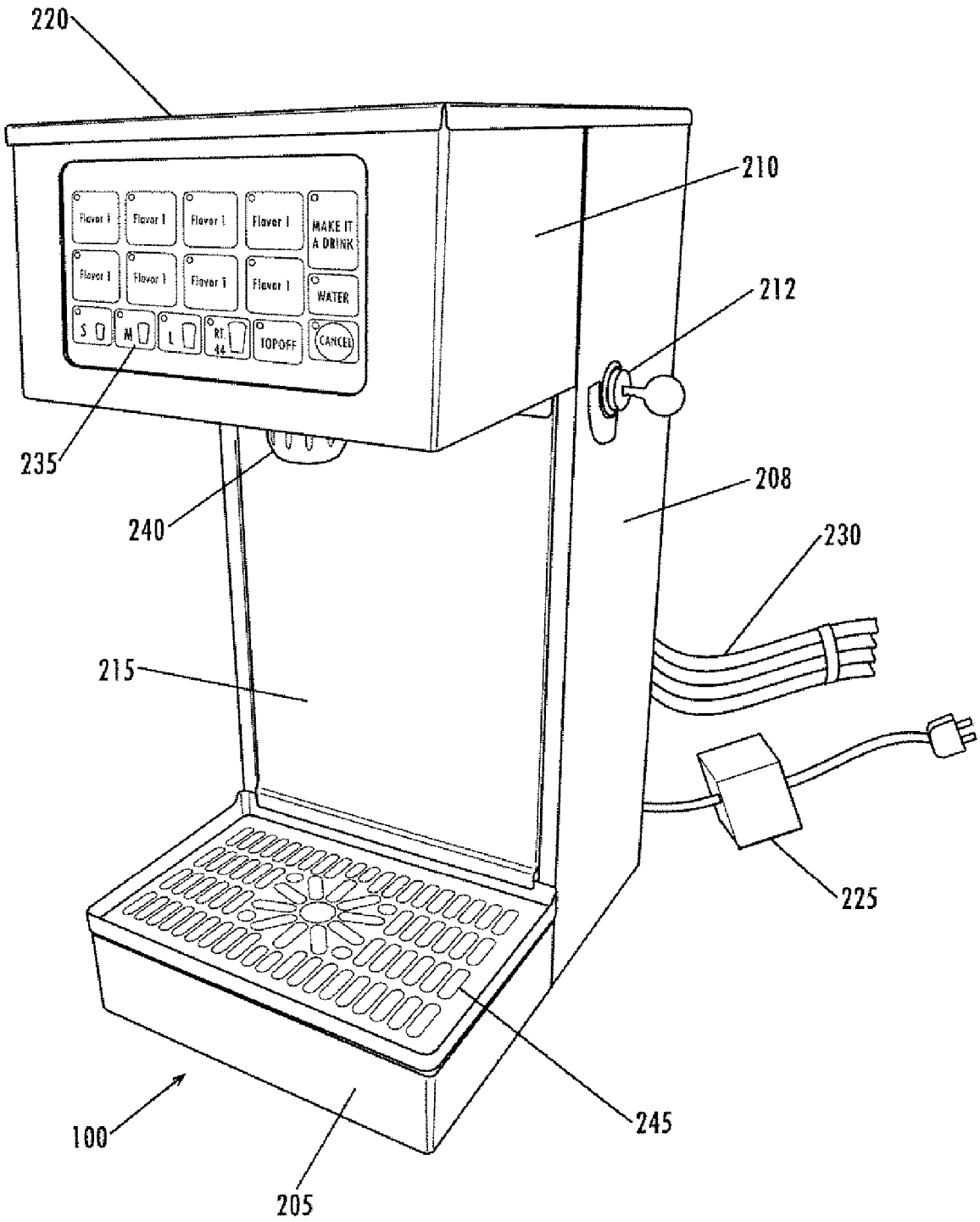
FIG. 2 is a perspective view of a beverage tower according to an illustrative embodiment of the present invention.

FIG. 2 is a perspective view of the beverage tower 100 according to an illustrative embodiment of the present invention. The beverage tower 100 may include a base portion 205, a trunk portion 208, and an upper portion 210. Also shown in FIG. 2, the beverage tower 100 may include a lock and key mechanism 212, a front access panel 215, a top access panel 220, an electric plug assembly 225, input tubing 230, a user interface panel 235, a nozzle cap 240, and a drip pan 245.

The base portion 205 of the beverage tower 100 may be fixidly or removably attached to the trunk portion 208. The upper portion 210 may be attached to the trunk portion 208 of the beverage tower 100 by upper portion hinges (not shown); however, it will be understood that other methods besides hinges may be used to attach the upper portion 210 to the trunk portion 208 of the beverage tower 100. For example, a variety of screws, tabs, snaps, bolts, or other devices could be used to facilitate the attachments, some of which may be fixed and others of which may be moveable. Hinges are used by the present invention primarily to allow for easy opening of the beverage tower 100, as will be explained in greater detail below.

The top access panel 220 may be removably attached on top of both the upper portion 210 and the top of the trunk portion 208 of the beverage tower 100. The top access panel 220 may provide protection to internal components of the beverage tower 100, and the top access panel 220 may also prevent the beverage tower 100 from being opened when it is in place. The top access panel 220 may simply rest on top of the beverage tower 100 or, alternatively, it may be secured in place on the beverage tower 100. A variety of screws, tabs, snaps, bolts, or other devices could be used to facilitate the secured attachment of the top access panel 220 to the beverage tower 100 and the attachment may be a fixed attachment or a moveable attachment. When the top access panel 220 is removed, the beverage tower 100 may be considered opened, as explained in greater detail below.

Figure 3:
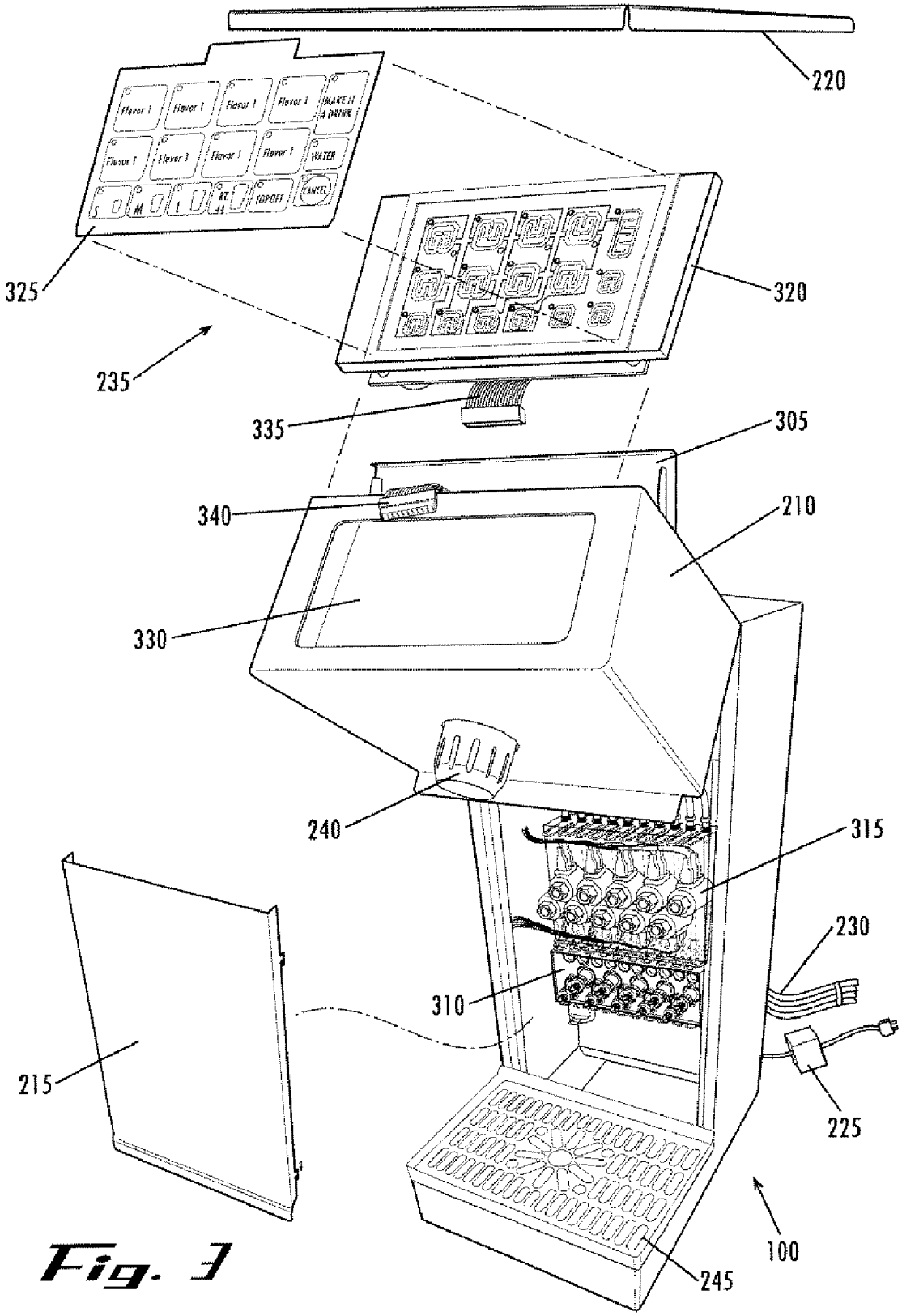
FIG. 3 is a partially exploded view of the various components of a beverage tower according to an illustrative embodiment of the present invention.

Additionally, the opening or closing of the beverage tower 100 and/or delivery of power to the beverage tower 100 may be controlled by the lock and key mechanism 212. When the lock and key mechanism 212 is unlocked and the top access panel 220 is removed, the upper portion 210 of the beverage tower 100 may be opened upward (as shown in FIG. 3), allowing easy access to internal components of the beverage tower. Additionally, when the upper portion 210 is in an opened position, the front access panel 215 may be removed, allowing additional access to the internal components of the beverage tower 100. The easy access to internal components of the beverage tower 100 may assist in maintenance and service of the beverage tower 100 and its components. The front access panel 215 may be removably attached to the trunk portion 208 of the beverage tower 100, and the front access panel 215 may provide protection to internal components of the beverage tower 100. The front access panel 215 may be held in place by the upper portion 210 of the beverage tower 100 or, alternatively, it may be secured in place by any suitable means such as, for example, screws, tabs, snaps, or bolts. It will be understood that the opening or closing of the beverage tower 100 and/or delivery of power to the beverage tower 100 may be controlled by other mechanisms or devices than the lock and key mechanism 212. For example, the delivery of power to the beverage tower 100 may be controlled by a power switch or button situated on the beverage tower 100.

Also shown in FIG. 2, the beverage tower 100 may receive electrical power from an electric plug assembly 225, which may include a standard two or three-prong electric plug. The electric plug assembly 225 may further include a power transformer that is capable of receiving a standard electrical power signal such as, for example, a power signal of approximately 120V (or approximately 240V in European applications) and supplying the beverage tower 100 with an appropriate power signal. The power signal provided to the beverage tower 100 may be a relatively low voltage signal such as, for example, a 12V power signal.

The beverage tower 100 may receive flavor syrup(s) 105 and water 110 through input tubing 230. The input tubing 230 may be any tubing suitable for transporting a liquid to the beverage tower 100 such as, for example, rubber or plastic tubing. The input tubing 230 may include one or more tubes that may or may not be insulated. For example, the input tubing 230 used to transport water 110 from a prechiller 115 to the beverage tower 100 may be insulated in order to maintain the water 110 at a desired temperature. The input tubing 230 may be insulated with any suitable insulation material capable of maintaining a substance transported through the input tubing 230 at a desired temperature, as will be understood by those skilled in the art.

A user interface panel 235 or control panel may be utilized to select either a flavor shot or a blended beverage for a variety of different cup sizes, as explained in greater detail below with reference to FIGS. 8-10. When a flavor shot or blended beverage is selected, it is dispensed by the beverage tower 100 through a nozzle block 402, as explained in greater detail below with reference to FIGS. 4A-5C. After the beverage is dispensed through the nozzle block 402, its flow may be partially or completed directed by a nozzle cap 240 into a cup or other container (not shown). Although the nozzle cap 240 is designed to minimize splash, splatter, and overspray of the dispensed flavor shot or blended beverage, as will be explained below, a drip pan 245 may be provided in the base portion 205 of the beverage tower 100 to catch any splash, splatter, or overspray by the beverage tower 100 and any spillover from the cup. The drip pan 245 may further be removable for emptying and cleaning. It will be understood by those of skill in the art that a drain may be provided at the bottom of the drip pan 245, and that the drain may transport any splash, splatter, overspray, or spillover away from the beverage tower 100.

In FIG. 2, the beverage tower 100 is depicted as a C-shaped body that has a relatively small footprint and is easily transportable. As shown, the beverage tower 100 is approximately 8⅜" wide by approximately 11½" deep, and the beverage tower 100 is approximately 18⅜" tall. Due to its size, the beverage tower 100 is commonly referred to as a 2-wide valve towers as will be understandable by those skilled in the art; however, it will be understood that the beverage tower 100 of the present invention may be implemented in many different sizes and configurations. For example, the beverage tower 100 may be integrated into a larger six or eight-wide valve tower. In such a configuration, the beverage tower 100 may essentially replace two nozzles of the larger beverage tower, such as the two center nozzles, thereby creating a combined dispenser with additional nozzles on either side of the beverage tower 100 portion.

FIG. 3 is a partially exploded view of the various components of a beverage tower 100 according to an illustrative embodiment of the present invention. As shown in FIG. 3, the upper portion 210 is in its opened position, the front access panel 215 has been removed, and the top access panel 220 has been removed.

FIG. 3 also shows an upper portion access panel 305 in the upper portion 210 of the beverage tower 100. The upper portion access panel 305 may be opened in order to provide easy access to the user interface panel 235 and its various components. The upper portion access panel 305 may provide protection to the electronics of the user interface panel 235 and assist in preventing undesirable moisture or leakage associated with the beverage tower from contacting the various components of the user interface panel 235. The upper portion access panel 305 may be attached to the upper portion 210 of the beverage tower 100 by hinges (not shown); however, it will be understood that other methods besides hinges can be used to attach the upper portion access panel 305 to the upper portion 210. A variety of screws, tabs, snaps, bolts, or other devices could be used to facilitate the attachments, some of which may be fixed and others of which may be moveable. Hinges are used by the present invention primarily to allow for easy access to internal components; however, other forms of attachments could be advantageous in that it allows easy servicing of the user interface panel 235. It will also be appreciated that the upper portion access panel 305 may be removably attached to the upper portion 210 of the beverage tower 100.

Many of the internal components of the beverage tower 100 may be seen in FIG. 3 including a flow control block 310 and a solenoid or switching block 315, which is shown as an acrylic block in this and other figures so that its internal components are partially visible. Additionally, the internal components of the user interface panel 235 may be seen in FIG. 3, including an interface and control cassette 320, an interface card 325, and an upper portion opening 330. The functionality of each of these components and the operation of the beverage tower is explained in greater detail below.

In operation, when a flavor syrup(s) 105 enters the beverage tower 100 by the input tubing 230, the flavor syrup(s) 105 enters the flow control block 310, which includes a plurality of adjustable orifices (e.g., valves) that define the flow rate of the flavor syrup(s) 105. The flow rate may be individually controlled for each flavor syrup 105 and the flow rate for each flavor syrup 105 may be set so it remains constant at a set rate for each flavor syrup. When a flavor syrup exits the flow control block 310, it then flows to the solenoid block 315 and then from the solenoid block to a nozzle block 402 (FIGS. 4A, 5A-5D) in the upper portion 210, as discussed below with reference to FIGS. 4A and 5A-5D. The solenoid block 315 may include a plurality of solenoids that control a gate in the flow path of each of the flavor syrups. When a gate is opened, a flavor syrup will be allowed to flow to the nozzle block 402, where it can be dispensed by the beverage tower 100. The interface and control cassette 320 may control the actuation of the various solenoids of the solenoid block 315 based on user input, thereby allowing a user of the beverage tower 100 to select a flavor syrup or beverage to be dispensed from the beverage tower 100. The functionalities of each of these internal components will be described in greater detail below. It will be understood water 110 may flow through the beverage tower 100 in the same manner that a flavor syrup 105 flows through the beverage tower 100.

FIG. 3 also shows the internal components of the user interface panel 235 or control panel of the beverage tower 100, which may include an interface and control cassette 320 and an interface card 325. The internal components of the user interface panel 235 may be accessed when the upper portion access panel 305 is lifted into an opened position. The interface and control cassette 320, which may be a removable cassette, may be situated inside the upper portion 210 of the beverage tower 100. In order to provide power to the interface and control cassette 320 and/or to facilitate communication between the interface and control cassette 320 and other components of the beverage tower 100 such as, for example, the solenoid block 315, the interface and control cassette 320 may include a cassette plug 335 that may be connected to an associated beverage tower plug 340, as shown in FIG. 3. The interface and control cassette 320 may include a control unit (FIG. 6A) such as, for example, a computing device that is programmable to provide the control logic for the beverage tower 100, as will be described in greater detail below with reference to FIG. 6A. Additionally, as explained in greater detail below with reference to FIGS. 6A-6B, the interface and control cassette 320 may be capable of receiving user input for the beverage tower 100. It will be understood that other types of user interface panels may be utilized in accordance with the present invention as an alternative to the interface and control cassette 320 and the interface card 325. Other types of user interface panels may include, for example, one or more liquid crystal displays (LCD's) or one or more touch screen displays.

Additionally, an interface card 325 or selection card may be inserted between the interface and control cassette 320 and the front of the upper portion 210 of the beverage tower 100. The interface card 325 may be a removable card or, alternatively, it may be affixed inside the upper portion 210 of the beverage tower 100. It will be understood that the interface card 325 may also be affixed to the front of the upper portion 210 of the beverage tower 100 rather than being situated inside the upper portion 210. If the interface card 325 is inserted inside the upper portion 210 of the beverage tower 100, it may be viewed and accessed through an upper portion opening 330 situated in the front of the upper portion 210. The interface card 325 may provide indicia identifying the various flavor syrups and/or beverages available for dispensing from the beverage tower 100, the available size selections, other user selectable options, as well as marketing indicia. The indicia may be printed on the interface card 325 and/or may be at least partially formed integrally into the interface card 325. The flavor syrups and/or beverages corresponding to that shown on the interface card 325 may be programmed into the interface and control cassette 320, as explained in greater detail below. When desired, such as when the flavors provided by the beverage tower 100 are changed and/or the control logic of the interface and control cassette 320 is changed, a different interface card 325 may be inserted into the beverage tower 100. For example, the interface card 325 may be changed as the selection of flavor shots and beverages dispensed by the beverage tower 100 changes.

It will be understood by those of skill in the art that the interface card 325 and the interface and control cassette 320 may be distinct components as shown in FIG. 3 or, alternatively, some or all of the aspects of one of the components may be incorporated into the other component. For example, the ability to display available flavor shots and beverages may be incorporated into the interface and control cassette 320 by providing a touch screen display on the interface and control cassette 320 from which a user can both view and select available flavor shots and beverages. As another example, the interface card 325 may be disposed remote from the interface and control cassette 320 but include the ability to receive user input and transmit any received user input to the interface and control cassette 320. The interface card 325 may be configured to receive user input by incorporating suitable user input devices into the interface card 325 such as, for example, push buttons, contact switches, mouse and/or keyboard, touch screen displays, or capacitive resistance input devices.

Figure 4A:
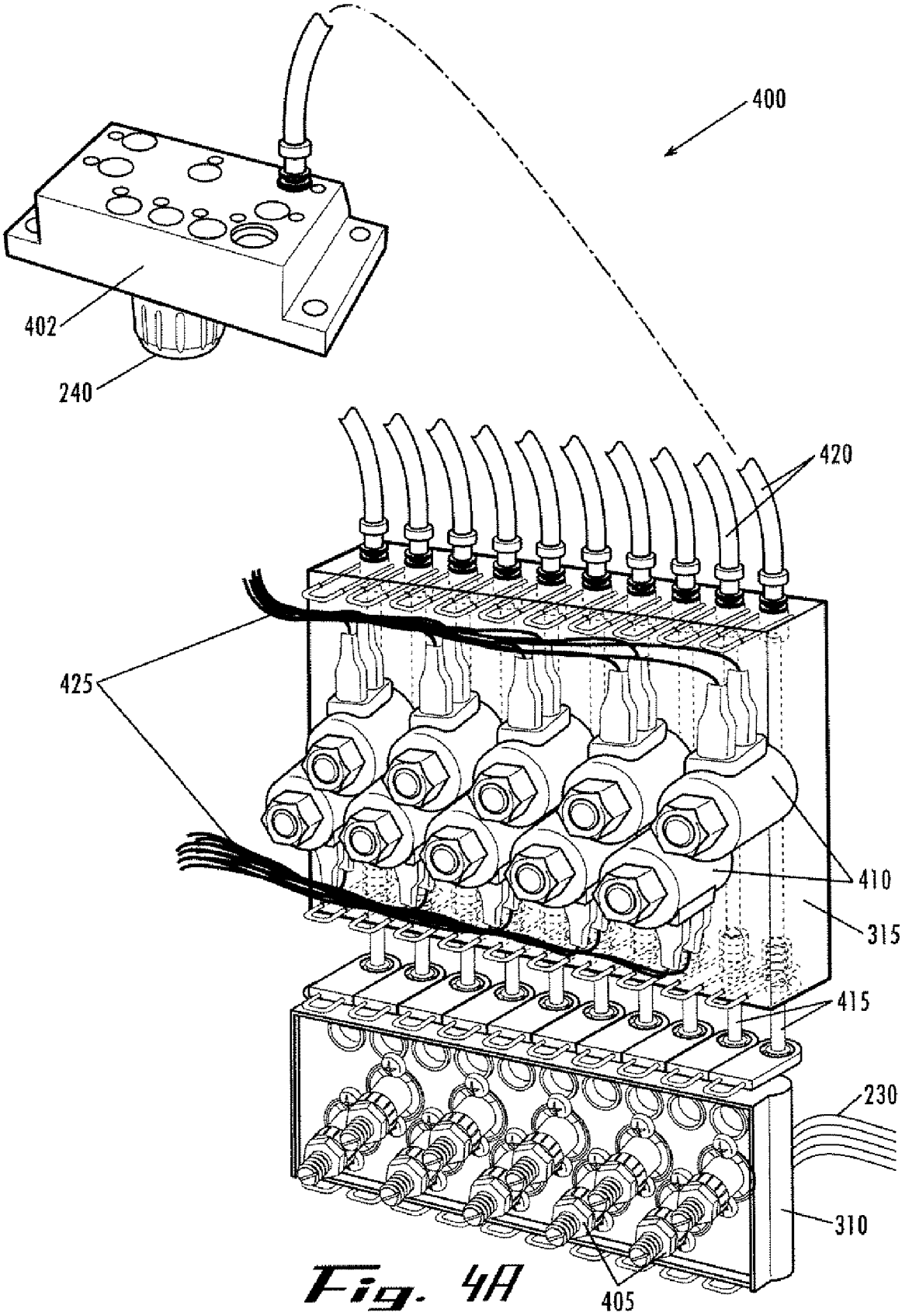
FIG. 4A is a perspective view of the flow control system utilized by a beverage tower, according to an illustrative embodiment of the present invention.

FIG. 4A is a perspective view of the flow control system 400 utilized by a beverage tower 100, according to an illustrative embodiment of the present invention. The flow control system may include a flow control block 310, a solenoid block 315, and a nozzle block 402. In operation, after a flavor syrup 105 or water 110 enters the beverage tower 100 via input tubing 230, it flows into the flow control block 310 and then to the solenoid block 315. A solenoid in the solenoid block 315 may be actuated by the interface and control cassette 320 in order to allow the flavor syrup 105 or water 110 to flow to the nozzle block 402 for dispense by the beverage tower 100. Although the solenoid block 315 is described herein as being situated downstream from the flow control block 310, it will be appreciated that the flow control block 310 may be situated downstream from the solenoid block 315.

The flow control block 310 of the beverage tower 100 may include one or more adjustable orifices (e.g., valves) 405 or flow rate devices that define the flow rate of the flavor syrup(s) 105 and water 110 provided to the flow control block 310 by the input tubing 230. Although valves are shown in FIG. 4A, it will be appreciated that other means for controlling flow rate may be utilized in accordance with the present invention such as, for example, one or more sized orifices. The flow control block 310 may provide an individual channel through which each of the flavor syrup(s) 105 and water 110 may pass or flow. The input tubing 230 may be coupled to the flow control block 310 of the beverage tower 100. More specifically, each tube of the input tubing 230 may be coupled to an associated or corresponding orifice or valve 405 of the flow control block 310. An orifice or valve 405 may be provided for each flavor syrup 105 or water 110 provided to the flow control block 310. The flow rate may be individually controlled for each flavor syrup 105 or water 110 by the orifice or valve 405. Additionally, the flow rate for each flavor syrup 105 or water 110 may be set so that it remains constant for each flavor syrup 105 or water 110. It will be understood that the flow control block 310 may be any suitable device for regulating the flow of one or more liquids. It will also be understood that the one or more orifices or valves 405 of the flow control block 310 may be situated or positioned in a staggered or offset array, thereby requiring relatively little space and, consequently, at least partially contributing to a relatively small footprint for the beverage tower 100.

The orifices or valves 405 of the flow control block 310 may be constructed from any suitable materials such as, for example, plastic, rubber, or a combination of plastic and rubber. The flow control block 310 may also be constructed from any number of suitable materials such as, for example, plastics, rubber, acrylics, metals, polymers, synthetic materials, or a combination of any such materials.

When a flavor syrup 105 or water 110 exits the flow control block 310, it may then be transported to the solenoid block 315 by solenoid input tubing 415. The solenoid input tubing 415, which may or may not be insulated, may be any tubing suitable for transporting a liquid from the flow control block 310 to the solenoid block 315 such as, for example, rubber or plastic tubing. The solenoid input tubing 415 may be terminated at the edges of the solenoid block 315, as explained in greater detail below. Alternatively, the solenoid input tubing 415 may further extend into the solenoid block 315 to one or more solenoids 410 included within the solenoid block 315. One or more suitable devices such as, for example, pins, staples, or braces, may secure the solenoid input tubing 415 in place at the solenoid block 315. Although the flow control block 310 and the solenoid block 315 are depicted as two separate and distinct components of the beverage tower 100, it will be understood that the flow control block 310 and the solenoid block 315 may be integrally formed as a single component of the beverage tower 100.

The solenoid block 315 may include one or more solenoids 410 that control a gate in the flow path of a flavor syrup 105 and/or water 110 through the solenoid block 315. A solenoid 410 may be provided for each flavor syrup 105 and for water 110. When a solenoid 410 is actuated or opened, a flavor syrup 105 or water 110 may be allowed to flow past the solenoid 410 and through the solenoid block 315 and then exit into output tubing 420, which carries the flavor syrup 105 or water 110 to the nozzle block 402, where it can be dispensed by the beverage tower 100. The interface and control cassette 320 may control the actuation of the various solenoids 410 of the solenoid block 315 based on user input, thereby allowing a user of the beverage tower 100 to select a flavor syrup 105 or beverage for dispense from the beverage tower 100. The control signal from the interface and control cassette 320 may be provided to the solenoids 410 via the solenoid wires 425, which may be any type of wire suitable for communicating an electrical signal to the solenoids 410.

The solenoid block 315 may form a centralized manifold for the array of solenoids 410. Use of a single block such as, for example, an acrylic block may decrease leak points and help maintain steady flow rates and pressure drops across the solenoid array. An acrylic block may also be easily machined and, if a clear acrylic block is utilized, the clear acrylic block may allow for increased visibility of the internal components of the solenoid block 315, thereby providing for easier trouble shooting of the solenoid block 315. A plurality of solenoids 410 may be laid out in a staggered array in the solenoid block 315, as illustrated. The staggered array may be a unique arrangement of the solenoids 410 that requires relatively little space, and, consequently, at least partially contributes to a relatively small footprint for the beverage tower 100. In the illustrative embodiment, the solenoid block 315 may be an acrylic block to which the plurality of solenoids 410 are attached, but it will be understood by those skilled in the art that many materials besides acrylic can be used to construct the solenoid block 315. Each solenoid 410 may include a coil of wire encased in a housing with a moving plunger or shaft. When electricity is applied to the coil of a solenoid 410, the resulting magnetic field may attract the plunger and pull it into the solenoid body, allowing flavor syrup 105 or water 110 to pass through the solenoid 410. When electricity is removed, the solenoid plunger may return to its original position via a return spring or gravity, preventing the flow of a flavor syrup 105 or water 110 through the solenoid 410. It will be understood by those of skill in the art that a variety of different solenoids could be utilized in the present invention including, but not limited to, AC solenoids, DC solenoids, linear open frame solenoids, linear tubular solenoids, rotary solenoids, or variable positioning solenoids. Each solenoid 410 in the solenoid block 315 may be any suitable solenoid such as, for example, a ST-021 solenoid manufactured by KIP, Inc.

When a flavor syrup 105 or water 110 enters the solenoid block 315 through the solenoid input tubing 415, the flavor syrup 105 or water 110 may flow to the one or more solenoids 410 via input channels 412 (FIG. 4B) integrated into the solenoid block 315. It will be appreciated that the solenoid input tubing 415 may extend into the solenoid block 315 as an alternative to integrating input channels 412 into the solenoid block 315. Electricity may be applied to the one or more solenoids 410 by way of the solenoid electric wires 425, actuating the plunger to allow the flavor syrup 105 or water 110 to flow past the individual solenoid 410 into output channels 414 (FIG. 4B) integrated into the solenoid block 315 and then into output tubing 420, which may then carry the flavor syrup 105 or water 110 to the nozzle block 402. Electricity may be applied according to the control logic of the beverage tower 100, as will be explained in greater detail below. As shown in FIG. 4A, the output tubing 420 may terminate at the edge of the solenoid block 315; however, it will be appreciated that the output tubing 420 may extend into the solenoid block 315 as an alternative to integrating output channels 414 into the solenoid block 315. The output tubing 420 may or may not be insulated and may further be any tubing suitable for transporting a liquid from the solenoid block 315 to the nozzle block 402 such as, for example, rubber or plastic tubing. One or more suitable devices such as, for example, pins, staples, or braces, may secure the output tubing 420 in place as it passes from the solenoid block 315 to the nozzle block 402.

Figure 4B:
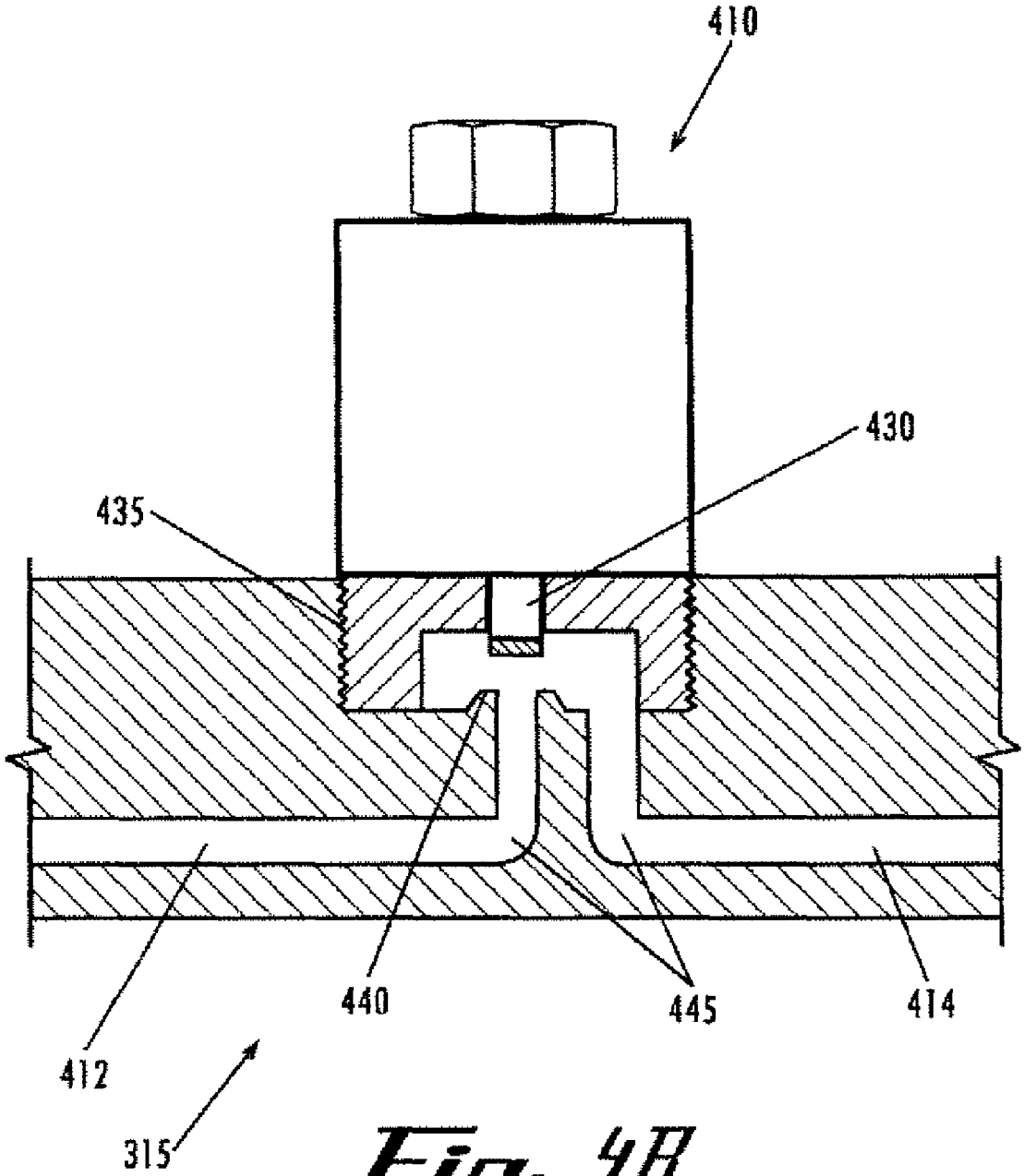
FIG. 4B is a cross-sectional view of a solenoid utilized by a beverage tower, according to an illustrative embodiment of the present invention.

FIG. 4B is a cross-sectional view of a solenoid 410 situated in a solenoid block 315 utilized by a beverage tower 100, according to an illustrative embodiment of the present invention. The solenoid block 315 may include input channels 412 and output channels 414 for each solenoid 410. The input channels 412 may be connected to the solenoid input tubing 415 and the output channels 414 may be connected to the output tubing 420 at the edges of the solenoid block 315. The solenoid 410 is situated operationally opposite the input and output channels 412, 414 so that its plunger 430 may block the flow of a flavor syrup 105 or water 110 passing through the solenoid block 315, as described above. The solenoid 410 may be screwed via a threaded portion 435 into the solenoid block 315; however, it will be understood that a solenoid 410 may be attached to the solenoid block 315 in a variety of other ways such as, for example, by a bonding material, adhesive material, or by magnetic force. The plunger 430 may make contact with a solenoid chamber contact point 440 when the solenoid 410 is not actuated, thereby blocking a flavor syrup 105 or water 110 from passing through the solenoid block 315. The bottom of the plunger 430 and/or the top of the solenoid chamber contact point 440 may be comprised of an elastic material such as, for example, rubber. The elastic material may assist in forming a seal between the plunger 430 and the solenoid chamber contact point 440 when the solenoid 410 is not actuated to prevent any undesirable leakage. When a solenoid 410 is actuated, the solenoid plunger 430 may recoil so that it no longer makes contact with the solenoid chamber contact point 440, and a flavor syrup 105 or water 110 may be permitted to flow from the input channel 412 to the output channel 414 and out of the solenoid block 315 at the flow rate defined by the corresponding valve 405 of the flow control block 310.

According to an aspect of the present invention, the input channel 412 and/or the output channel 414 may include a bend 445. The bend(s) 445 may be situated in the channels 412, 414 within the solenoid block 315. Additionally, the bend(s) of the input and output channels 412, 414 may be formed with gradual turns thereby helping to maintain constant pressure across the solenoid 410 and to avoid unwanted pressure drops in the solenoid block 315. It will be understood that many different slopes or gradients may be utilized for the bend(s) 440 such as, for example, a slope of approximately ninety degrees.

With reference back to FIG. 4A, when a flavor shot 105 or water 110 exits the solenoid block 315, it may pass through the output tubing 420 to the nozzle block 402. From the nozzle block 402, the flavor shot 105 or water 110 may be dispensed by the beverage tower 100. The flavor shot 105 or water 110 may be dispensed by a nozzle 505 (FIGS. 5A-5D) included in the nozzle block 402, as will be explained in greater detail below with reference to FIGS. 5A-5D. After being dispensed by the nozzle block 402, the flavor shot 105 or water 110 may pass through a nozzle cap 240. The nozzle cap 240 may assist in directing the flow of the dispensed flavor syrup 105 or water 110, thereby assisting in the prevention of splash, splatter, and/or overspray by the nozzle block 402.

Figure 5A:
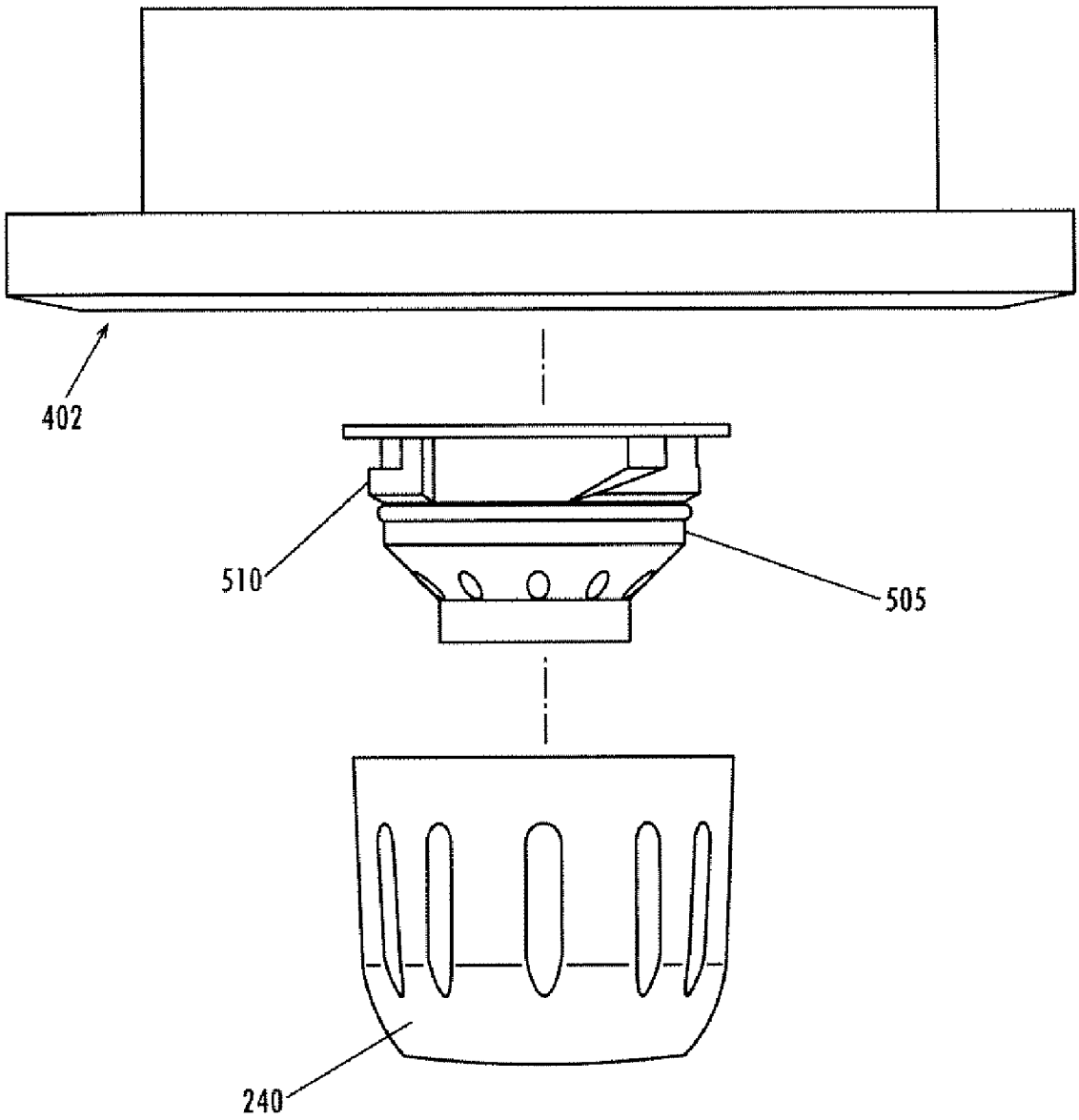
FIG. 5A is a front view of a nozzle block utilized by a beverage tower, according to an illustrative embodiment of the present invention.
Figure 5B:
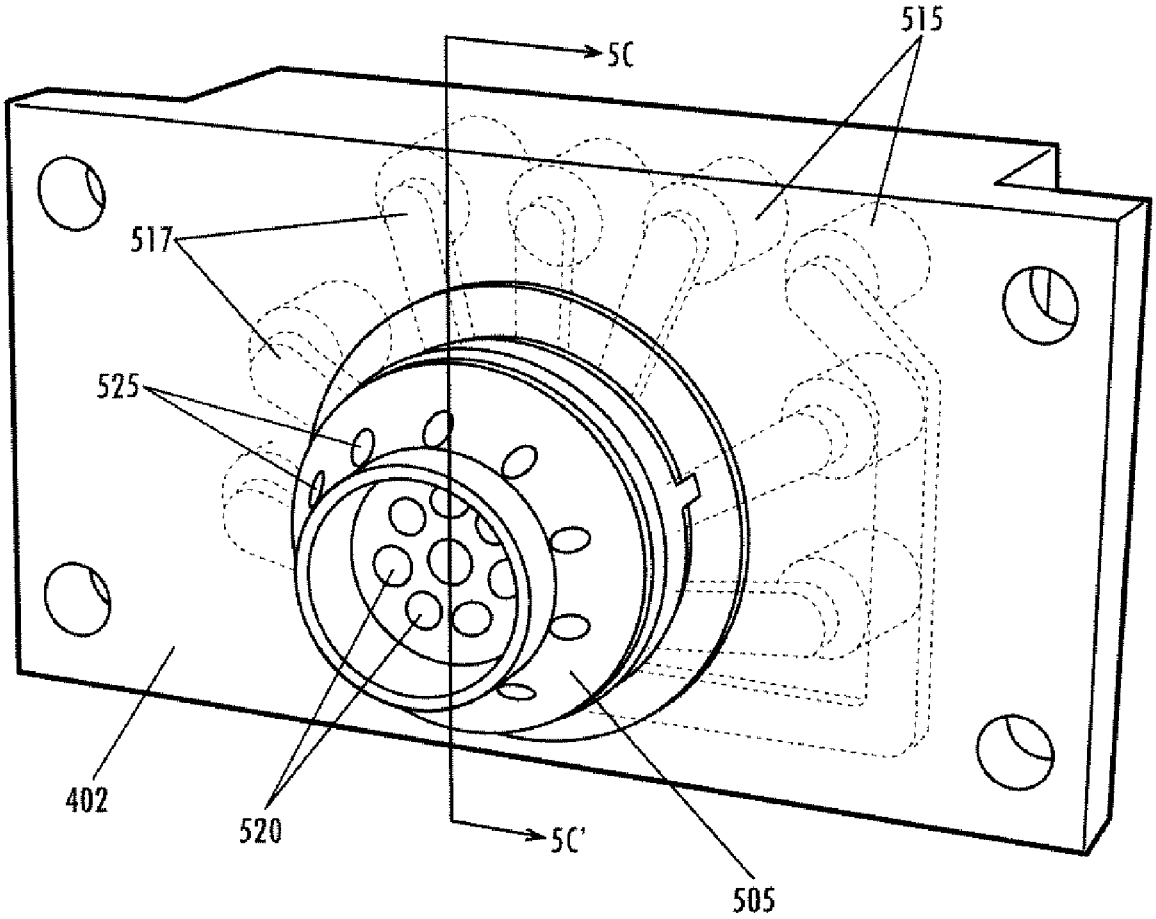
FIG. 5B is a perspective view of a nozzle block utilized by a beverage tower, wherein certain features internal to the nozzle block are shown in phantom lines, according to an illustrative embodiment of the present invention.

FIG. 5A is a front view of a nozzle block 402 utilized by a beverage tower 100, according to an illustrative embodiment of the present invention. The nozzle block 402 may be made of acrylic or any other suitable material such as, for example, plastic. As shown in FIG. 5B, the nozzle block 402 may be made of a clear acrylic. An acrylic block may also be easily machined and, if a clear acrylic block is utilized, the clear acrylic block may allow for increased visibility of the internal components of the solenoid block 315, thereby providing for easier trouble shooting of the solenoid block 315. A nozzle cap 240 and a nozzle 505 may be removably or permanently affixed or connected to the nozzle block 402. The nozzle 505 and the nozzle cap 240 have been removed from the nozzle block 402 in FIG. 5A. The nozzle 505 may be permanently affixed to the nozzle block 402 or incorporated into the nozzle block 402. Alternatively, the nozzle 505 may include a threaded portion that may be screwed or twisted into a corresponding threaded portion within the nozzle block 402, thereby allowing the nozzle 505 to be removably attached to the nozzle block 402. It will be understood that a variety of other means may be utilized to permanently or removably attach the nozzle 505 to the nozzle block 402 such as, for example, screws, bolts, or adhesive. The inside of the nozzle cap 240 may contain tabs (not shown) that may fit into corresponding grooves 510 on the nozzle 505 or nozzle block 402, thereby allowing the nozzle cap 240 to be removably attached to the nozzle 505 or nozzle block 402. The nozzle cap 240 may be detached or removed from the nozzle block 402 in order to assist in the performance of maintenance on the nozzle block 402, nozzle 505 and the nozzle cap 240. It will be understood that the nozzle cap 240 may be connected in a variety of ways other than tabs and corresponding grooves. For example, the nozzle cap 240 may be connected to the nozzle block 402 or nozzle 505 by screws, snaps, corresponding threaded grooves, or an adhesive material. It will also be understood that the nozzle cap 240 may be permanently attached to the nozzle block 402 or nozzle 505.

FIG. 5B is a bottom perspective view of a nozzle block 402 and nozzle 505 utilized by a beverage tower 100, according to an illustrative embodiment of the present invention. As shown in FIG. 5B, the nozzle block 402 may additionally include input receptacles 515 that receive or couple to the output tubing 420. Flow channels 517 may receive the flavor syrup 105 or water 110 from the input receptacles 515 and direct the flow of the flavor syrup 105 or water 110 to an output opening 518 (FIG. 5C) corresponding to an associated input opening 519 of the nozzle (FIG. 5C) positioned opposite and coupled to the output opening 518 of the nozzle block 402 when the nozzle 505 is securely coupled to the nozzle block 402. The nozzle 505 may additionally include flavor syrup injectors (or flavor shot dispensers) 520 and water injectors 525 (or water dispensers). The functionality of these components is described in greater detail below with reference to FIG. 5C.

Figure 5C:
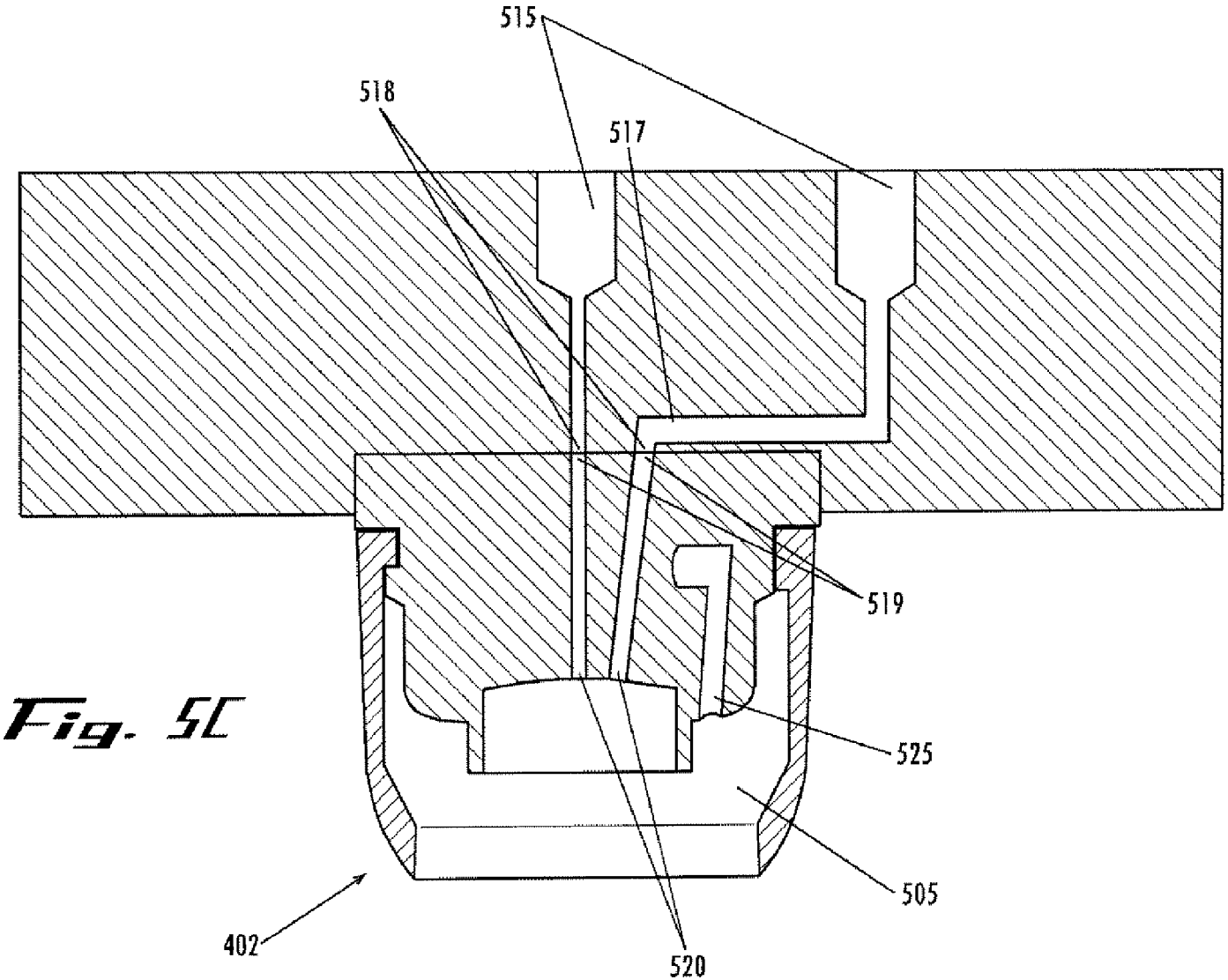
FIG. 5C is a cross-sectional view of a nozzle block utilized by a beverage tower taken along lines 5C-5C' of FIG. 5B, according to an illustrative embodiment of the present invention.

FIG. 5C is a cross-sectional view of a nozzle block 402 utilized by a beverage tower 100, according to an illustrative embodiment of the present invention. As shown in FIG. 5C, the input receptacles 515 may receive a flavor syrup 105 or water 110 from the output tubing 420, and the input receptacles 515 may then interface with the flow channels 517 that carry the flavor syrup 105 and water 110 through the nozzle block 402 to the nozzle 505. Additionally, the diameter of the input receptacles 515 may be greater than the diameter of the flow channels 517 to accommodate the coupling of the output tubing 425 to the nozzle block 402. This decrease in diameter of the flow channels 517 through the nozzle block 402 may increase by a desired amount the pressure of the transported flavor syrup 105 or water 110 at the point of dispense of the nozzle block 402. It will be understood that the decrease in diameter of the flow channels 517 through the nozzle block 402 may be many different values such as, for example, a decrease in the range of approximately twenty percent to approximately seventy percent.

Additionally, each of the flow channels 517 may include an output opening 518 at its distal end. The output opening 518 may be positioned at the interface of the nozzle block 402 and the nozzle 505. Additionally, each of the output openings 518 may be positioned opposite to and coupled to a corresponding input opening 519 of the nozzle 505. The input openings 519 may be positioned in the nozzle 505 at the interface of the nozzle 505 and the nozzle block 402. Each of the input openings 519 may additionally be incorporated into either a flavor syrup injector 520 or a water injector 525 of the nozzle 505, as explained in greater detail below. In operation, a flavor syrup 105 may flow from a flow channel 517 to a flavor syrup injector 520 via the output opening 518 of the flow channel 517 and the corresponding input opening 519 of the flavor syrup injector 520. Similarly, water 110 may flow from a flow channel 517 to a water injector 525 via the output opening 518 of the flow channel 517 and the corresponding input opening 519 of the water injector 525.

In operation, when a flavor syrup 105, water 110, or blended beverage is dispensed by the beverage tower 100, it is dispensed through the nozzle 505. A flavor shot may be a controlled dispense of a flavor syrup 105. Flavor shots may be dispensed from the nozzle 505 through one or more flavor syrup injectors 520 situated in the center portion of the bottom of the nozzle 505, with each flavor syrup injector 520 opening along the bottom of the nozzle 505. A single flavor syrup injector 520 may be associated with each flavor syrup 105 supplied to the beverage tower 100 or, alternatively, each flavor syrup 105 may be dispensed through a plurality of flavor syrup injectors 520. Additionally, one or more of the flavor syrup injectors 520 may open at a slight angle towards the center point of the bottom of the nozzle 505, as explained in greater detail below. Water 110 may be dispensed from the nozzle 505 through a plurality of water injectors 525 situated in a ring around the flavor syrup injectors 520 on the bottom of the nozzle 505, as explained in greater detail below. Alternatively, the openings for the plurality of water injectors 525 may be situated along the outer side wall of the nozzle 505, and the water injectors 525 may open at a slightly downward angle. As the water injectors 525 dispense water out of the side of the nozzle 505, the water flow may or may not be directed by the nozzle cap 240, as will be described in greater detail below.

Figure 5D:
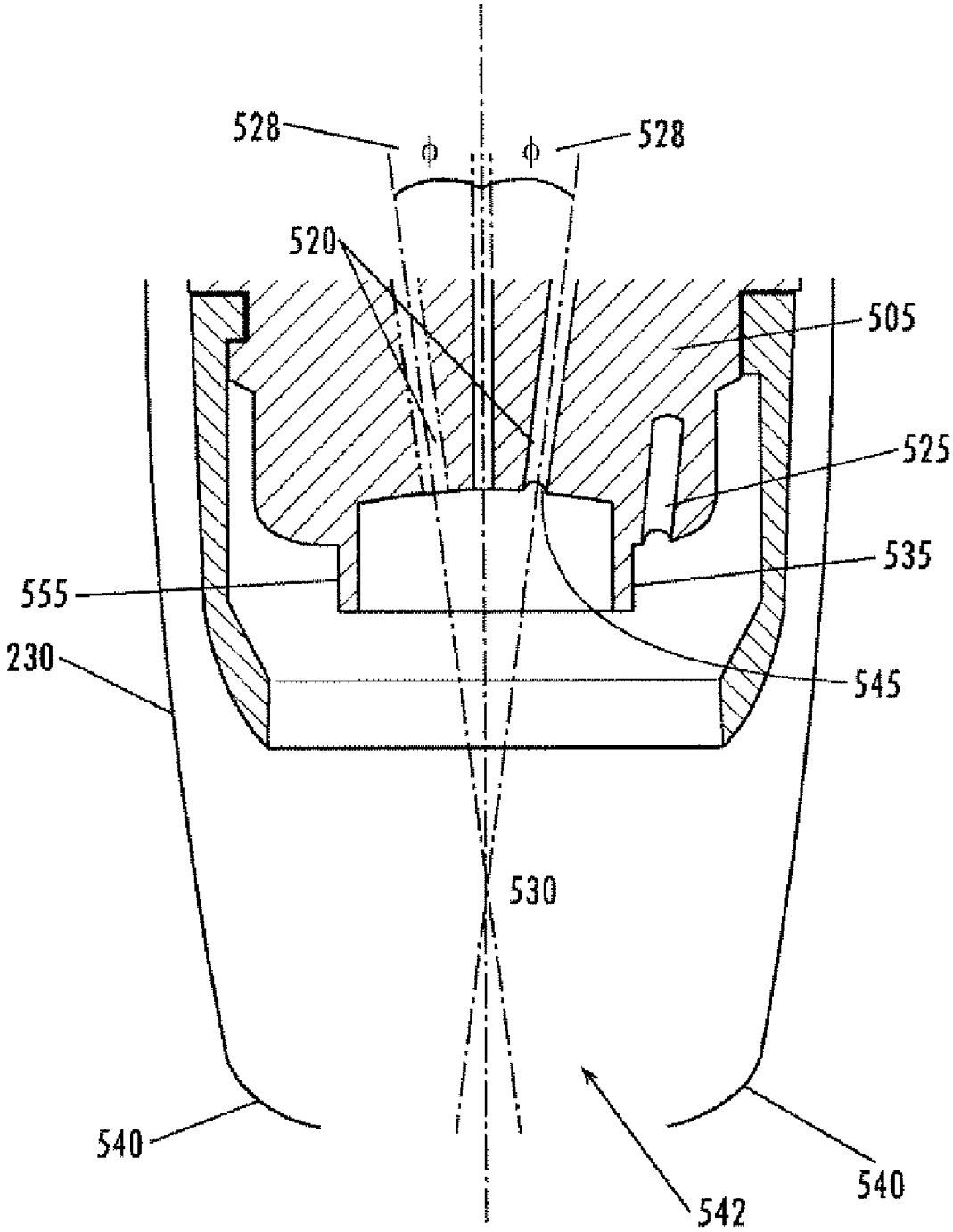
FIG. 5D is a schematic cross-sectional view illustrating the operation of a nozzle block utilized by a beverage tower, according to an illustrative embodiment of the present invention.

FIG. 5D shows the operation of the nozzle 505 and nozzle cap 240 of a beverage tower 100, according to an illustrative embodiment of the present invention. When a flavor shot is dispensed by the beverage tower 100, it may be dispensed from a flavor syrup injector 520 of the nozzle 505. The flavor syrup injector 520 may dispense the flavor shot from the bottom of the nozzle 505 at a slight angle Φ 528 from a central longitudinal axis of the nozzle 505. Additionally, each of the flavor syrup injectors 520 may dispense flavor shots so that they pass through a focal point 530 that may be situated below the nozzle 505 and/or the nozzle cap 240. Directing flavor shots at a single focal point 530 may help to minimize splash, splatter, and overspray. Additionally, it may provide for easier blending of the beverages dispensed from the beverage tower 100. It will be appreciated that many different values may be utilized for Φ 528 in accordance with the present invention. It will further be appreciated that the value of Φ 528 may be in part determined by the desired location of the focal point 530.

When water 110 is dispensed from the beverage tower 100, it may be dispensed from the nozzle 505 through a plurality of water injectors 525 that may be situated in a ring around the flavor syrup injectors 520 on the bottom of the nozzle 505. Dispensed water 110 may make contact with the nozzle 505 after it is dispensed. For example, the dispensed water 110 may contact a nozzle projection 535 that extends downwardly from the nozzle 505 between the openings of the flavor syrup injectors 520 and the water injectors 525. Many different types and shapes of nozzle projections 535 may be used in accordance with the present invention such as, for example, a circular or elliptical nozzle projection. The nozzle 505 and/or nozzle projection 535 may assist in directing the flow of the dispensed water 110. It will also be understood that the dispensed water 110 may make contact with the nozzle cap 240. For example, in an embodiment in which the water injectors 525 are situated on the outer side wall of the nozzle 505, the dispensed water 110 may make contact with the nozzle cap 240, and the nozzle cap 240 may assist in directing the flow of the water 110. In situations where the nozzle cap 240 assists in directing the flow of the water, inward projections 540 situated at the opening 542 or distal end of the nozzle cap 240 may assist in concentrating the flow of the water 110 as it exits the nozzle cap 240. This concentration of the water 110 may assist in the blending of beverages dispensed from the beverage tower 100.

When a blended beverage is dispensed from the beverage tower 100, both a flavor syrup 105 and water 110 may be dispensed through the nozzle 505, as described above. The dispensed flavor syrup 105 may make contact with the dispensed water 110 at or near the focal point 530 and the dispensed flavor syrup 105 may then be mixed with the dispensed water 110. According to an aspect of the present invention, the mixing of the dispensed flavor syrup 105 and the dispensed water 110 may occur at a point below both the nozzle 505 and nozzle cap 240; however, it will be understood that in some embodiments of the present invention, the mixing of the flavor syrup 105 and water 110 may occur within the nozzle cap 240 or even within the beverage tower 100 prior to dispense. According to another aspect of the present invention, the brix of the blended beverage, which is defined as the ratio of flavor syrup 105 to water 110 in the blended beverage, preferably does not vary by more than approximately one degree throughout the beverage.

According to yet another aspect of the present invention, color and flavor carryover may be minimized by the beverage tower 100. Color or flavor carryover may occur if an undesirable amount of flavor syrup 105 is dispensed into or drips into a flavor shot or beverage that does not call for that particular flavor syrup 105. The beverage tower 100 of the present invention may minimize color or flavor carryover by implementing an injector mouth 545 that may be formed in a concave or recessed manner extending upstream into the flavor syrup injector 520. The degree of concavity of the flavor syrup injector 520 may be defined by the arcuate surface formed by the injector mouth. A capillary effect may be created by the concave injector mouth 545 which retains a flavor syrup 105 in the flavor syrup injector 520. Droplets of a flavor syrup 105 may be prevented from forming at the injector mouth 545 and, therefore, may be prevented from dripping into a dispensed beverage or flavor shot, minimizing color or flavor carryover. It is to be understood by those skilled in the art that other methods for minimizing color of flavor carryover may be utilized by the present invention, such as providing for a water wash to wash out any flavor syrup droplets that form along the flavor syrup injectors 520.

Figure 6A:
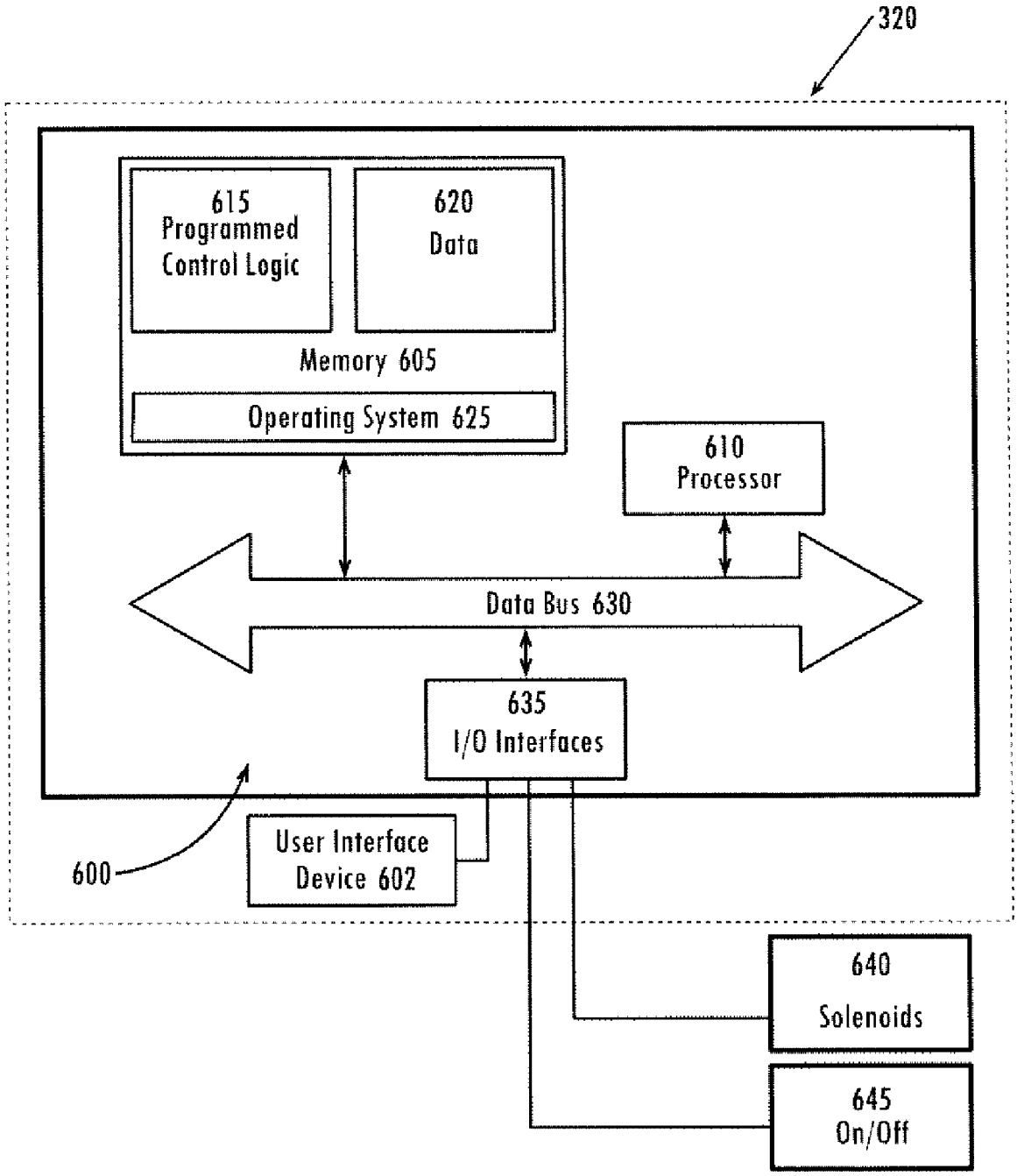
FIG. 6A is a block diagram of a user interface and control cassette utilized by a beverage tower, according to an illustrative embodiment of the present invention.

FIG. 6A is a block diagram of a user interface and control cassette 320, which may include a control unit 600 utilized by a beverage tower 100, according to an illustrative embodiment of the present invention. The control unit 600 in the present embodiment is integrated with a user interface device 602; however, it will be understood by those of skill in the art that the control unit 600 may be provided separately from but in communication with the user interface device 602 or any other user input devices.

As shown in FIG. 6A, the control unit 600 may include a memory 605 and a processor 610. The memory 605 may store programmed control logic 615 (e.g., software code) in accordance with the present invention. The memory 605 may also include data 620 utilized in the operation of the present invention and an operating system 625. The processor 610 may utilize the operating system 625 to execute the programmed control logic 615, and in doing so, may also utilize any stored data 620. The programmed control logic 615 may include the logic associated with operation of the beverage tower 100, as illustratively provided for in FIGS. 8-13. A data bus 630 may provide communication between the memory 605 and the processor 610. The control unit 600 may be in communication with the other components of the beverage tower 100 and perhaps other external devices, such as the prechiller 115, the carbonator 125, and/or keyboards or other user interface devices, via an I/O Interface 635. The control unit 600 may also communicate with the user interface device 602, the solenoids 640, and/or an on/off indication 645 of the beverage tower via the I/O Interface 635. Further, the control unit 600 and the programmed control logic 615 implemented thereby may comprise software, hardware, firmware or any combination thereof.

The user interface device 602 may receive user input associated with the operation of the beverage tower 100, and the user input may then be communicated to the control unit 600. According to an aspect of the present invention, the user interface device 602 may make use of capacitance resistance technology to receive user input that, as described in U.S. Pat. No. 6,452,514, which is incorporated by reference herein. The capacitance resistance used by the user interface device 602 of the present invention is a form of capacitance resistance known as charge-transfer or QT sensing. Two or more electrodes may be arranged to create an electric field transmitted through an adjacent dielectric which can be disturbed by the proximity of an object, such as a human finger.

Figure 6B:
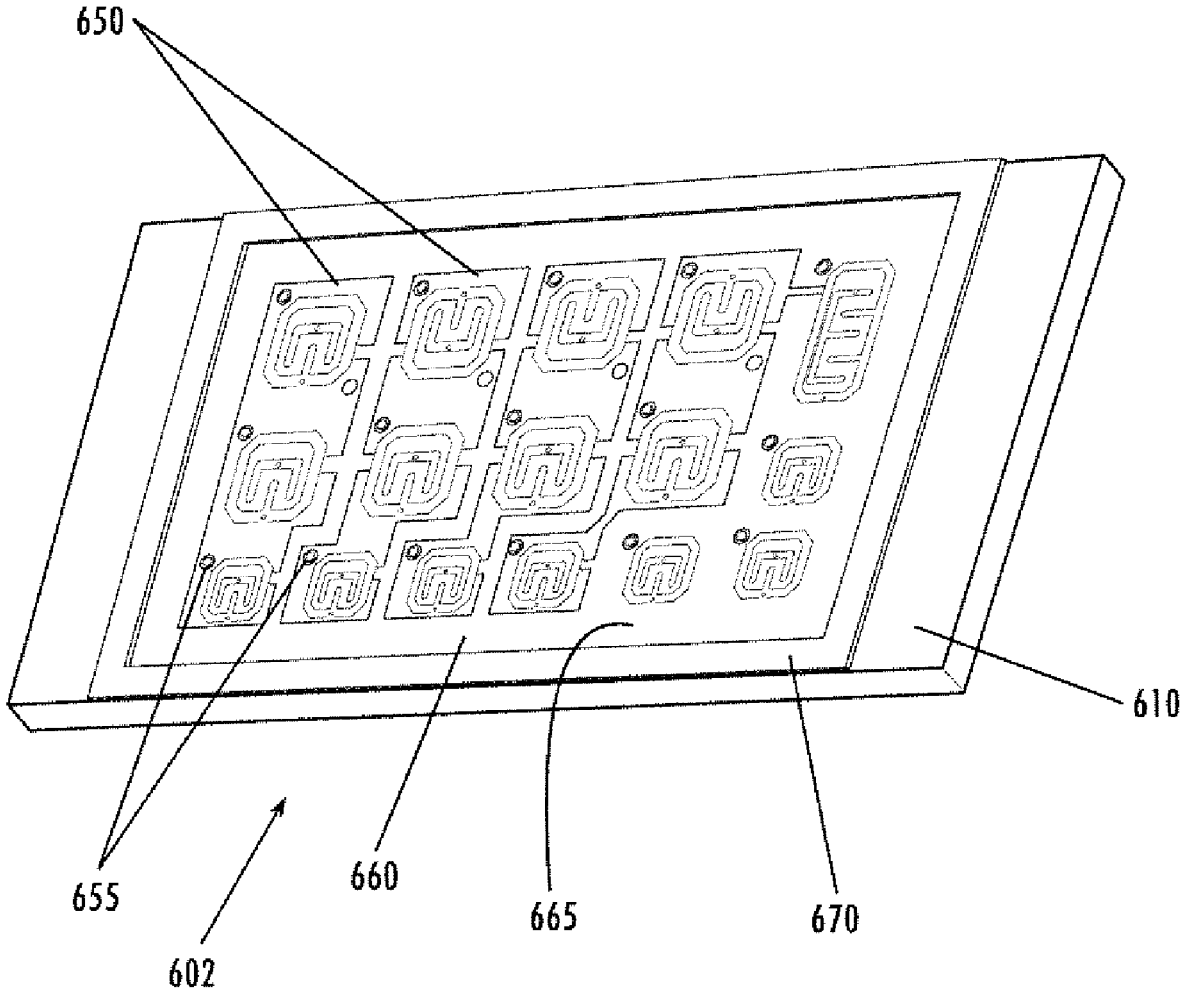
FIG. 6B is a perspective view of a user interface device utilized by a beverage tower, according to an illustrative embodiment of the present invention.

In addition to the block diagram of the control unit 600, FIG. 6B illustrates a perspective view of the user interface device 602 according to an illustrative embodiment of the present invention. As shown in FIG. 6B, the user interface device 602 may include sensing elements or keys 650 and visual indicators 655 that may be associated with a corresponding sensing element 650. The sensing elements or keys 650, which will be described in greater detail below with reference to FIG. 7, may be formed in an array on a front sensing surface 660 of the user interface device 602. Each sensing element 650 may be connected to a voltage drive source (not shown) and to a charge detector (not shown) in accordance with capacitance resistance technology. Each visual indicator 655 may be a light emitting diode (LED) that indicates to the user when a sensing element 650 has been selected; however, it will be understood by those of skill in the art that while a visual indicator is not required, a variety of visual indicators may be used in accordance with the present invention such as, for example, an LED display or a liquid crystal display (LCD).

When an object such as, for example, a user's finger comes into close proximity with a sensing element 650, the electric field generated by the sensing element 650 is disturbed and the charge detector indicates a sensing element or key activation. According to an aspect of the present invention, the sensing surface 660 of the user interface device 602 does not need to physically contact an object used to activate a sensing element 650. This may assist in minimizing any wear on the sensing element 650 and may further increase the overall reliability and lifetime of the beverage tower 100.

According to another aspect of the present invention, objects may be allowed to make contact with a front surface 665 of the user interface device 602 without contacting the sensing surface 660 of the user interface device 602. The front surface 665 may be situated in front of the sensing surface 660 and may protect the sensing surface 660 of the user interface device 602. Additionally, a gap may exist between the front surface 665 and the sensing surface 660 of the user interface device 602. An object may contact the front surface 665 and disturb the electric field generated by an individual sensing element 650, thereby causing a key activation to be recognized by the control unit 600. The front surface 665 of the user interface device 602 may be composed of a clear acrylic sheet that may be surrounded by a black ABS bezel along its outside edge or, alternatively, it may be constructed from any material through which an electric field may pass, such as plastic or glass. An user interface device seal 670 may encircle the outer edge of the front surface 665 along the line of contact of the front surface 665. The user interface device seal 670 may help to prevent dirt and moisture from damaging the user interface device 602.

It will also be understood by those skilled in the art that rather than making use of capacitive switching technology, many other types of buttons or switches may be utilized in accordance with the present invention. These switches include, but are not limited to, electric contact switches, debounced contact switches, and any mechanical switch, toggle, or button that can be activated by a user.

Figure 7:
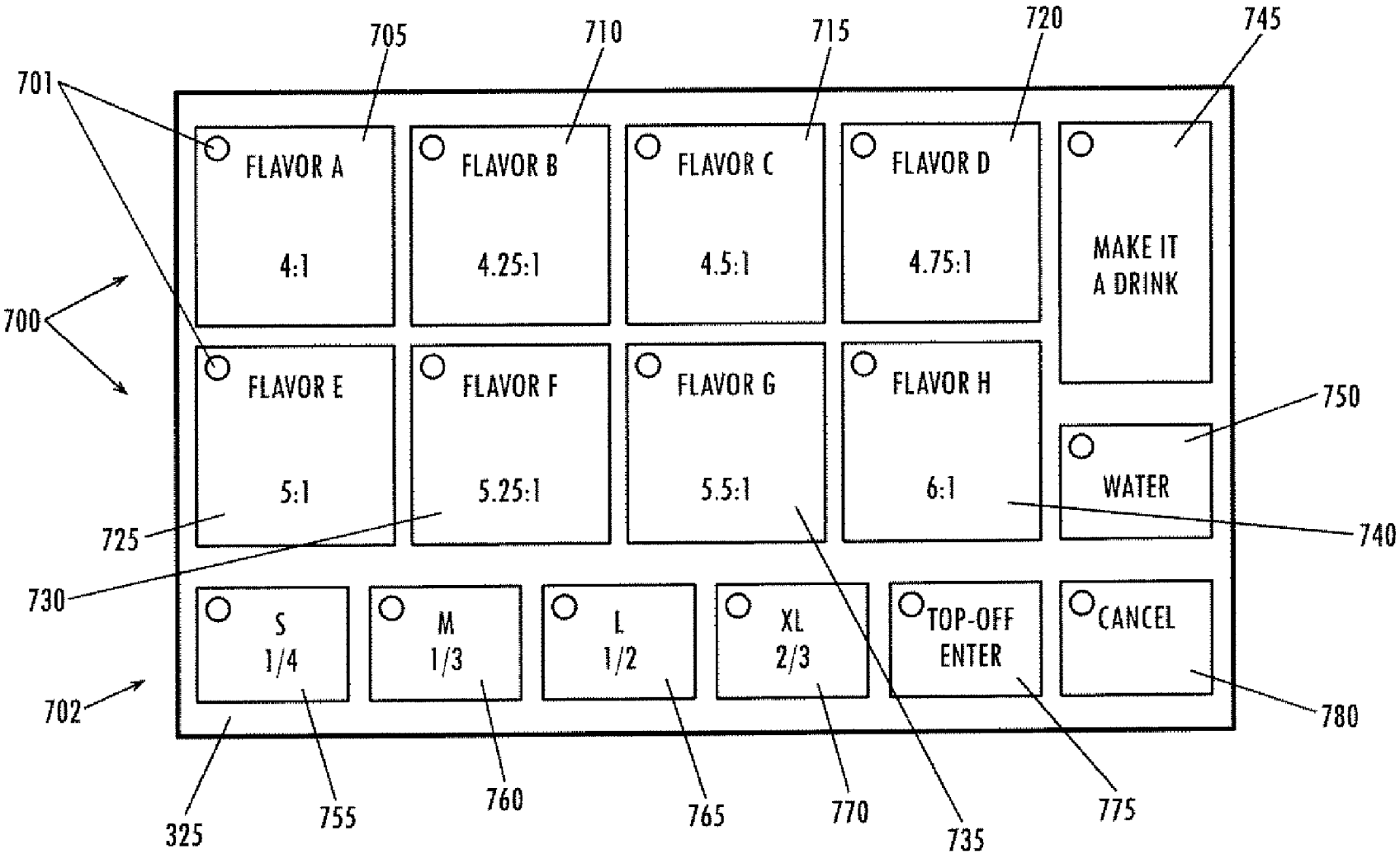
FIG. 7 is a front view of an interface card utilized by a beverage tower, according to an illustrative embodiment of the present invention.

FIG. 7 is a front view of an interface card 325 utilized by a beverage tower 100, according to an illustrative embodiment of the present invention. The interface card 325 may be a removable card that illustrates the various flavor shots or beverages that may be dispensed by the beverage tower 100. In operation, the interface card 325 may be situated in the gap between the front surface 665 and the sensing surface 660 of the user interface device 602. In such a configuration, the interface card 325 may not make contact with an object used to activate a sensing element 650 of the user interface device 602. Alternatively, the interface card 325 may be positioned between the user interface device 602 and the front wall of the upper portion 210 of the beverage tower 100 where it can be accessed through the opening 330 in the upper portion 210. As another alternative, the interface card 325 may be fixidly or removably attached to the front of the upper portion 210 such as, for example, in a situation when the beverage tower 100 does not have an opening 330 in the upper portion 210.

According to an aspect of the present invention, The interface card 325 may be constructed from a mylar polycarbonate film that is approximately 0.010 millimeters thick, but it is to be understood that the access card could be formed from a multitude of different materials having a multitude of thicknesses. If the interface card 325 is situated between the front surface 665 and the sensing surface 660 of the user interface device 602, the thickness of the interface card 325 needs to be small enough to allow the interface card 325 to fit in the gap between the two surfaces 660, 665 and allow the electric field generated by the sensing elements 650 to pass through it. Other materials that may be used to construct the interface card 325 include, but are not limited to paper, cardboard, polycarbonate materials, plastic, glass, and acrylic. Mylar is preferred because it is an extraordinarily strong polyester film that provides superior strength, heat resistance, and insulating properties. Constructing the interface card 325 out of mylar may also result in a card that resists sticking to either the front surface 665 or the sensing surface 660 and, as a result, may be easily removable.

According to another aspect of the present invention, the interface card 325 provides an illustrative example of the various flavor shots or beverages that may be dispensed by the beverage tower 100. The various flavor shots or beverages shown on the interface card 325 may be associated with the sensing elements 650 of the user interface device 602. The user interface device 602 may utilize sensing elements 650 of varying shapes and sizes, and these varying shapes and sizes of the sensing elements 650 may correspond to selective elements shown on the interface card 325. Additionally, the interface card 325 may contain gaps or transparent areas 701 that correspond to or are associated with the visual indicators 655 of the user interface device 602.

According to an aspect of the present invention, when a user disrupts the electric field generated by a sensing element 650 of the user interface device 602, the sensing element 650 may be activated. The selection element layout of the interface card 325 may correspond to the individual sensing elements 650 formed on the sensing surface 660, which will generally correspond with the selection element layout of the user interface device 602. It will be understood by those skilled in the art that many different sensing element shapes and/or sensing element layouts may be formed on the sensing surface 660 and on the corresponding interface card 325. The layout of the interface card 325 shown in FIG. 7 is merely illustrative of one such possible configuration. For purposes of the present disclosure, the various selection elements of the interface card 325 will be referred to as keys, and the keys will correspond to the sensing elements 650 of the user interface device 602.

In the exemplary configuration or layout shown in FIG. 7, there are sixteen different keys or selection elements shown on the interface card 325. There are eight large square flavor keys 700 shown. Individual flavor keys 705, 710, 715, 720, 725, 730, 735 and 740, represent the various flavor syrups 105 that may be dispensed by the beverage tower 100 as either a flavor shot or as part of a blended beverage. More specifically, a first flavor key 705 may be used for Flavor A; a second flavor key 710 may be used for Flavor B; a third flavor key 715 may be used for Flavor C; a fourth flavor key 720 may be used for Flavor D; a fifth flavor key 725 may be used for Flavor E, a sixth flavor key 730 may be used for Flavor F; a seventh flavor key 735 may be used for Flavor G; and an eight flavor key 740 may be used for Flavor H. Additionally, the large keys 705, 710, 715, 720, 725, 730, 735, 740 may represent the various water to flavor syrup ratios that may be programmed into the interface and control cassette 320 for dispensing blended beverages by the beverage tower 100. The various water to flavor syrup ratios may represent the volumetric quantity of water 110 to flavor syrup 105 in a post-mix blended fountain beverage. More specifically, the first flavor key 705 may be used to select a 4:1 ratio; the second flavor key 710 may be used to select a 4.25:1 ratio; the third flavor key 715 may be used to select a 4.5:1 ratio; the fourth flavor key 720 may be used to select a 4.75:1 ratio; the fifth flavor key 725 may be used to select a 5:1 ratio, the sixth flavor key 730 may be used to select a 5.25:1 ratio; the seventh flavor key 735 may be used to select a 5.5:1 ratio; and the eighth flavor key 740 may be used to select a 6:1 ratio.

Also illustrated by FIG. 7 as part of the exemplary layout of the interface card 325 is a beverage key 745, also referred to as the "make it a drink" key. The beverage key 745 may be used in the normal dispense mode of the beverage tower 100 to dispense a blended beverage rather than a flavor shot, as explained in greater detail below. Additionally, the beverage key 745 may be used when programming the interface and control cassette 325 to toggle whether or not a blended beverage can be dispensed for a particular flavor syrup 105. The exemplary layout of the interface card 325 also illustrates seven smaller keys. The individual smaller keys 750, 755, 760, 765, 770, 775, and 780 may be utilized by the beverage tower 100 for various purposes. A water key 750 may be used to dispense water containing no flavor syrup(s) 105 from the beverage tower 100. A cancel key 780 may be used to cancel a flavor shot or beverage selection in the normal dispense mode or to cancel selections made when programming the interface and control cassette 320. A top-off key 775 is also shown. When the top-off key 775 is pressed during the normal dispense mode of the beverage tower 100, the beverage tower 100 will dispense either water 110 or a blended beverage if either was the last substance dispensed by the beverage tower 100; however, the beverage tower 100 will not dispense a flavor shot when the top-off key 775 is pressed if a flavor shot was the last substance dispensed by the beverage tower 100. When programming the interface and control cassette 320, the top off key 775 may be used as an enter key, confirming selections and saving options chosen during programming and, for purposes of this disclosure, the top off key 775 may be referred to as the enter key. The remaining small keys are cup size keys 702. Individually numbered cup size keys 755, 760, 765, and 770 represent the various cup sizes that the beverage tower 100 can accommodate. More specifically, a small cup size key 755 may be used for a small cup size; a medium cup size key 760 may be used for a medium cup size; a large cup size key 765 may be used for a large cup size; and an extra-large cup size key 770 may be used for an extra-large cup size. The volume of a flavor shot or blended beverage dispensed by the beverage tower 100 in its normal dispense mode may be determined by the cup size key that is selected. Additionally, the cup size keys 755, 760, 765, 770 may represent the shot size increments that are selected when programming the interface and control cassette 320. More specifically, the small cup size key 755 may be used for a ¼ ounce shot size increment; the medium cup size key 760 may be used for a ⅓ ounce shot size increment; the large cup size key 765 may be used for a ½ ounce shout size increment, and the extra-large cup size key 770 may be used for a ⅔ ounce shot size increment. The shot size increments represent the volume of flavor syrup 105 that is dispensed for a particular cup size for either a flavor shot or for a blended beverage. As an example, if a ½ ounce shot size ratio was chosen for Flavor A, then a ½ ounce flavor shot would be dispensed for a small cup size, a 1 ounce flavor shot would be dispensed for a medium cup size, a 1½ ounce flavor shot would be dispensed for a large cup size, and a 2 ounce flavor shot would be dispensed for an extra-large cup size. The control logic and functionality of all of the various keys depicted on the access card 325 will be described in greater detail below. It will be understood by those of skill in the art that any number of flavor keys, shot size increments, or cup sizes can be implemented by the present invention and those depicted and described are for illustrative purposes only.

According to another aspect of the present invention, the control logic of the beverage tower 100 may determine the operational functionality of the beverage tower 100, as discussed below with reference to FIGS. 8-13. That is, FIGS. 8-13 provide illustrative flowcharts of the operation and programming of the beverage tower 100 which is provided for by the programmed control logic 615 of the control unit 600.

Figure 8:
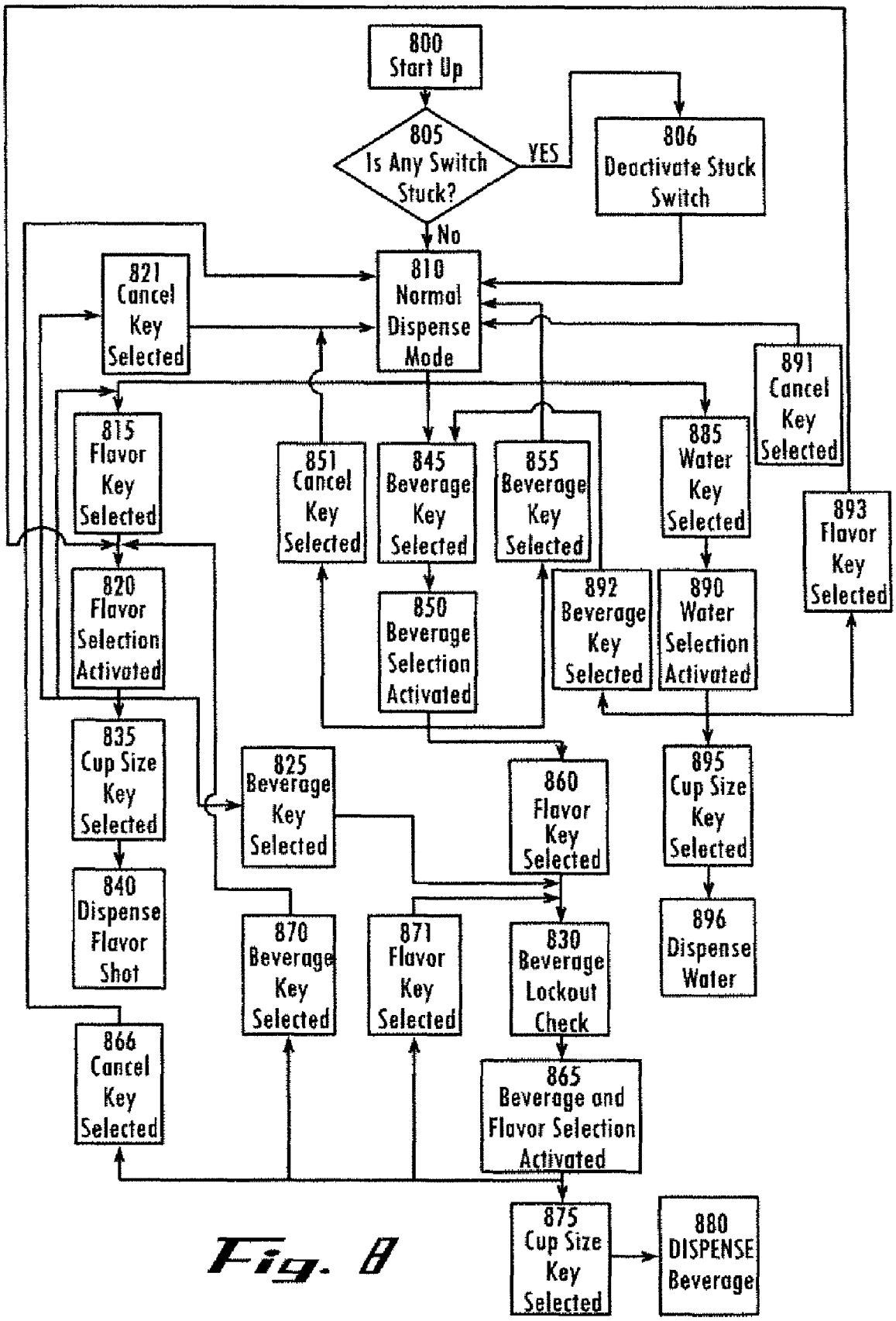
FIG. 8 is a flowchart of the control logic of a beverage tower operating in a normal dispense mode, according to an illustrative embodiment of the present invention.

FIG. 8 is a flowchart of the programmed control logic 615 of the control unit 600 of a beverage tower 100 operating in a normal dispense mode, according to an illustrative embodiment of the present invention. The normal dispense mode of the beverage tower 100 may be the normal operating mode of the beverage tower 100 after electrical power has been applied to the beverage tower 100. When the beverage tower 100 is started up at step 800, a scan may be performed of all the sensing elements 650 or switches at step 805 to determine if any are stuck or otherwise inoperable. If one or more sensing elements 650 are determined to be stuck or inoperable at step 805, then those sensing element 650 may be deactivated at step 806, and then the control unit 600 may go to step 810 and enter its normal dispense mode. If no sensing elements 650 are determined to be stuck or inoperable at step 805, then the control unit 600 may go to step 810 which is its normal dispense mode.

Generally, when the beverage tower 100 is in its normal dispense mode, a user may select for dispense either flavor shots, water, and/or blended beverages. After a selection has been made by the user, the beverage tower 100 may dispense the desired flavor shot, water, or blended beverage. The user may make a selection by choosing one or more of the keys of the user interface panel 235 or control panel of the beverage tower 100. In making a selection, the user may choose from the options displayed on the interface card 325, thereby activating one or more keys of the user interface device 602. Generally, a user may make a selection by choosing a desired flavor syrup 105, a desired shot or cup size, and whether or not a flavor shot or a blended beverage is desired. Many different methods for the selection of various flavor shots, water, and/ or blended beverages may be utilized by the present invention, one of which is described below with reference to FIG. 8.

At step 810, if a flavor key 700 is selected while the control unit 600 is in the normal dispense mode, then the control unit 600 goes to step 815 where it determines which flavor key 700 was selected and then the control unit 600 goes to step 820 where the flavor selection is activated. Additionally, at step 820, a visual indicator 655 such as, for example, a light emitting diode (LED) corresponding to the selected flavor key 700 may be illuminated. The visual indicator 655 may remain illuminated for a predetermined period of time and/or until a subsequent user input, such as, for example, approximately 10 seconds or until the cancel key 780 is selected or another flavor key 700 is selected. If the cancel key 780 is selected while the control unit 600 is at step 820, then the control unit 600 may verify that cancel key 780 was selected at step 821 and then the visual indicator 655 may turn off and the control unit 600 may return to step 810.

If another flavor key 700 is selected while the control unit 600 is at step 820, then the previous flavor key selection may be cleared from memory (e.g., within the memory 605 associated with the control unit 600). The new flavor key selection may be determined at step 815 and the new flavor selection may be activated as the control unit 600 returns to step 820. Additionally, the visual indicator 655 for the prior flavor selection may be turned off and the visual indicator 655 for the new flavor selection may be activated. For purposes of the present example, only one visual indicator 655 for flavor selections may be active at any one time; however, it will be understood by those of skill in the art that multiple visual indicators 655 may be active at one time if the beverage tower 100 is configured to dispense more than one flavor shot at a time.

If, while the control unit 600 is at step 820, the beverage key 745 is selected, then the control unit 600 verifies the selection of the beverage key 745 at step 825 and then goes to step 830. Alternatively, if a cup size key 702 is selected while the control unit 600 is at step 820, then the control unit 600 will verify the individual cup size key 755, 760, 765, 770 that was selected at step 835 and then the control unit 600 may go to step 840. At step 840, the control unit 600 may dispense a flavor shot corresponding to the selected flavor key 700 in a volume corresponding to the selected cup size key 702. Additionally, a visual indicator 655 such as, for example, an LED representing the selected cup size key 702 may be illuminated while the beverage tower 100 is dispensing the flavor shot. Additionally, during dispense, all other key selections may be ignored except the cancel key 780. If the cancel key 780 is selected, then the dispense may be stopped. The visual indicator 655 representing the flavor key 700 of the dispensed flavor shot may remain illuminated for a predetermined period of time such as, for example, approximately 10 seconds after the last dispense. As explained in greater detail below, the top-off key 775 may not be operative following the dispense of flavor shots, thereby preventing a dispense of a large amount of a particular flavor syrup 105 as a shot into any given beverage. Due to this and other operator or user constraints, misuse of the beverage tower 100 may be minimized, thus lessening the training time needed to operate the equipment.

At step 810, if the beverage key 745 is selected while the control unit 600 is in its normal dispense mode, then the selection of the beverage key 745 may be verified at step 845 and the control unit 600 may then go to step 850. At step 850, the beverage selection may be activated. A visual indicator 655 associated with the beverage key 745 may also be illuminated at step 850. This visual indicator 655 may remain illuminated for a predetermined period of time and/or until a subsequent user input, such as, for example, approximately 10 seconds or until the cancel key 780 is selected or the beverage key 745 is reselected. If the cancel key 780 is selected while the control unit 600 is at step 850, then the control unit 600 may verify that the cancel key 780 was selected at step 851 and then the control unit 600 may return to step 810. If the beverage key 745 is selected while the control unit 600 is at step 850, then the control unit 600 may verify the selection of the beverage key 745 at step 855 and then return to step 810.

If a flavor key 700 is selected while the control unit 600 is at step 850, then the control unit 600 may verify the selection of the flavor key 700 at step 860 and then go to step 830. At step 830, the control unit 600 may perform a beverage lockout check, the details of which are described below with reference to FIG. 9. The beverage lockout check may determine whether or not a beverage option is available for the particular flavor syrup 105 or flavor shot that has been selected. If, at step 830, it is determined that a beverage is available for the selected flavor key 700, then the control unit 600 goes to step 865 and both the beverage and flavor selection are activated. Additionally, a visual indicator 655 associated with the selected flavor key 700 may be illuminated, and both the visual indicator 655 associated with the flavor key 700 and the visual indicator 655 associated with the beverage key 745 may remain illuminated for a predetermined period of time and/or until a subsequent user input, such as, for example, approximately 10 seconds or until the cancel key 780, the beverage key 745, or another flavor key 700 is selected. If, at step 865, the cancel key 780 is selected, then the control unit 600 may verify the selection of the cancel key 780 at step 866 and then return to step 810. If, at step 865, the beverage key 745 is selected, then the control unit may verify the selection of the beverage key 745 at step 870, the visual indicator 655 associated with the beverage key 745 may be deactivated, and the control unit 600 may then go to step 820. If, at step 865, another flavor key 700 is selected, then the control unit 600 may verify the selection of the flavor key 700 at step 871 and return to the beverage lockout check at step 830 to determine whether a beverage option is available for the currently selected flavor key 700. If, however, at step 865, while both the beverage and flavor selection is activated, a cup size key 702 is selected, then the control unit 600 may verify the selected cup size key 702 at step 875 and then go to step 880. At step 880, a blended beverage may be dispensed from the beverage tower 100 in a volume corresponding to the cup size key 702 selected. A visual indicator 655 representing the selected cup size key 702 may be illuminated for the approximate time that the beverage tower 100 is dispensing. Additionally, during dispense of the beverage, all other key selections may be ignored except for the cancel key 780. If the cancel key 780 is selected, then the dispense may be stopped. The visual indicator 655 representing the flavor key 700 of the dispensed flavor shot used in the beverage and the visual indicator 655 representing the beverage key 745 may remain illuminated for a predetermined period of time such as, for example, approximately 10 seconds after the last dispense of the beverage. In one embodiment of the present invention, if the top-off key 775 is selected after the dispense of the beverage, then the control unit 600 may direct the beverage tower 100 to dispense or pour the last beverage in memory, as described in greater detail below with reference to FIG. 10. The maximum continuous dispensing time for the top-off key 775 may be approximately 10 seconds. After approximately 10 seconds of continuous dispensing, the dispense may stop and the user may be required to reactivate the top-off key 775 to resume dispensing of the beverage.

When the control unit 600 is at step 810, if the water key 750 is selected, then the selection of the water key 750 may be verified at step 885 and the control unit 600 may go to step 890 where the water selection is activated. Additionally, if the water key 750 is selected after a flavor key 700 and/or the beverage key 745 have been selected, then any flavor selection (step 815), beverage selection (step 850), or beverage and flavor selection (step 865) may be cancelled and the control unit 600 may go to step 890 where the water selection is activated. At step 890, a visual indicator 655 such as, for example, an LED associated with the water key 750 may be illuminated and it may be the only illuminated visual indicator 655 on the interface and control cassette 320. The visual indicator 655 associated with the water key 750 may remain illuminated for a predetermined period of time and/or until a subsequent user input, such as, for example, approximately 10 seconds or until the cancel key 780, a flavor key 700, or the beverage key 745 is selected. If, at step 890, the cancel key 780 is selected, then the control unit 600 may verify the selection of the cancel key 780 at step 891 and then return to step 810. If at step 890, the beverage key 745 is selected, then the control unit 600 may verify the selection of the beverage key 745 at step 892 and then go to step 850. If, at step 890, a flavor key 700 is selected, then the control unit 600 may verify the selection of the flavor key 700 at step 893 and then go to step 820 where the flavor selection may be activated. If, however, at step 890, a cup size key 702 is selected, then the control unit 600 may verify the cup size key selection at step 895 and then go to step 896. At step 896, the control unit 600 may direct the beverage tower 100 to dispense a volume of water 110 corresponding to the cup size key 702 selected. A visual indicator 655 representing the selected cup size key 702 may be illuminated for the approximate time period that the beverage tower 100 is dispensing. During dispense, all other key selections may be ignored except for a selection of the cancel key 780. If the cancel key 780 is selected at step 896, then the dispense may be stopped. The visual indicator 655 representing the water key 750 may remain illuminated for a predetermined period of time such as, for example, approximately 10 seconds after the last dispense of water 110. If the top-off key 775 is selected, then the control unit 600 may direct the beverage tower 100 to dispense water 110 if water 110 was the last liquid dispensed, as explained in greater detail below with reference to FIG. 10. The maximum continuous dispensing time for the top-off key 775 may be approximately 10 seconds. After approximately 10 seconds of continuous dispensing, the dispense may stop and the user may be required to reactivate the top-off key 775 to resume dispensing.

The cancel key 780 may be selected at any point during the steps referenced above. If any substance is being dispensed from the beverage tower 100, the dispense may be immediately stopped, but the last beverage or flavor shot selection may remain in memory 605 for approximately 10 seconds. If no substance is being dispensed when the cancel key 780 is selected, then all selections may be cleared from memory 605 and the control unit 600 may return to step 810.

It is also to be understood by those of ordinary skill in the art that the present invention may be implemented in such a way as to allow multiple flavor selections to be made simultaneously, allowing for a greater number of flavor and beverage combination. For example, both a strawberry flavor and a lemonade flavor could be simultaneously selected to create a strawberry lemonade flavor shot or blended beverage.

Figure 9:
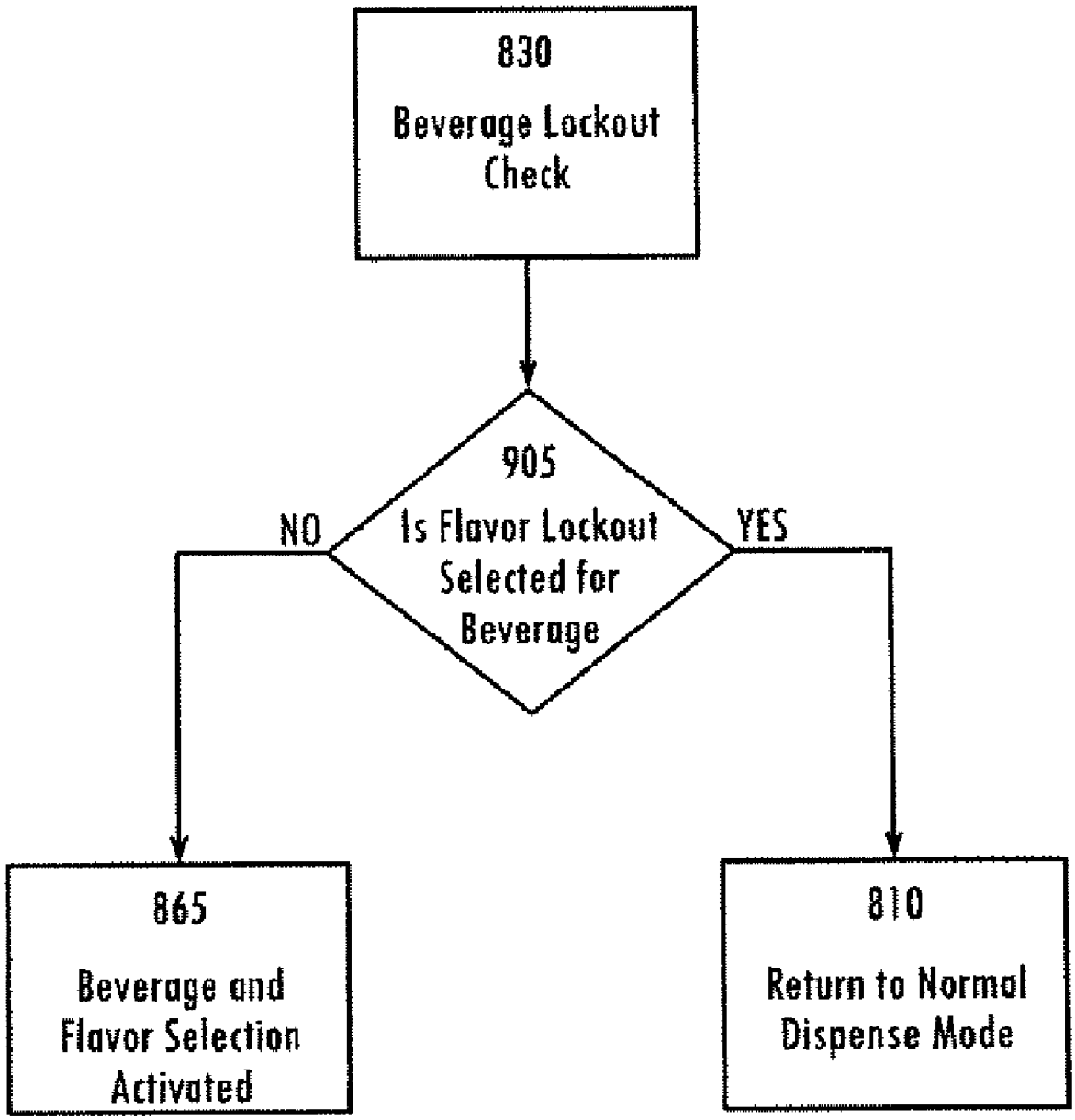
FIG. 9 is a flowchart of the control logic of a beverage lockout check, according to an illustrative embodiment of the present invention.

FIG. 9 is a flowchart of the programmed control logic 615 of a beverage lockout check, according to an illustrative embodiment of the present invention. The beverage lockout check may be utilized by the beverage tower 100 of the present invention in order to determine whether or not a blended beverage may be dispensed by the beverage tower 100 for a particular flavor syrup 105 or combination of flavor syrups 105. It may be desirable to allow a flavor shot to be dispensed by the beverage tower 100 for a particular flavored syrup(s) 105 while preventing a blended beverage from being dispensed for the particular flavor syrup(s). For example, the beverage tower 100 may be permitted to dispense a shot of vanilla syrup that may be added to another beverage such as, for example, a soda. The beverage tower 100, however, may not be permitted to dispense a blended vanilla beverage that includes vanilla syrup and water.

With reference to FIG. 9, when the beverage tower 100 is operating in its normal dispense mode and both a beverage key 745 and a flavor key 700 are selected, then the beverage tower may be at step 830 which is a beverage lockout check. At step 830, the control unit 600 may go to step 905 in order to determine whether or not a beverage may be created for a particular flavor syrup 105. If, at step 905, it is determined that a beverage is permitted for the selected flavor key 700, then control unit 600 may go to step 865 where both the beverage and flavor selections are activated. As shown in FIG. 9, a beverage may then be dispensed by selecting a cup size key 702. If, at step 905, it is determined that no beverage is permitted for the selected flavor key 700, then all of the selected keys may be deactivated and the control unit 600 may go to step 810. The beverage lockout check may be a particularly advantageous aspect of the present invention because it allows the beverage tower 100 to be configured so that a beverage is only permitted for selected flavor syrups 105 that are input into the beverage tower 100. It may, therefore, prevent misuse of the beverage tower 100 and minimize training time for operators or users.

Figure 10:
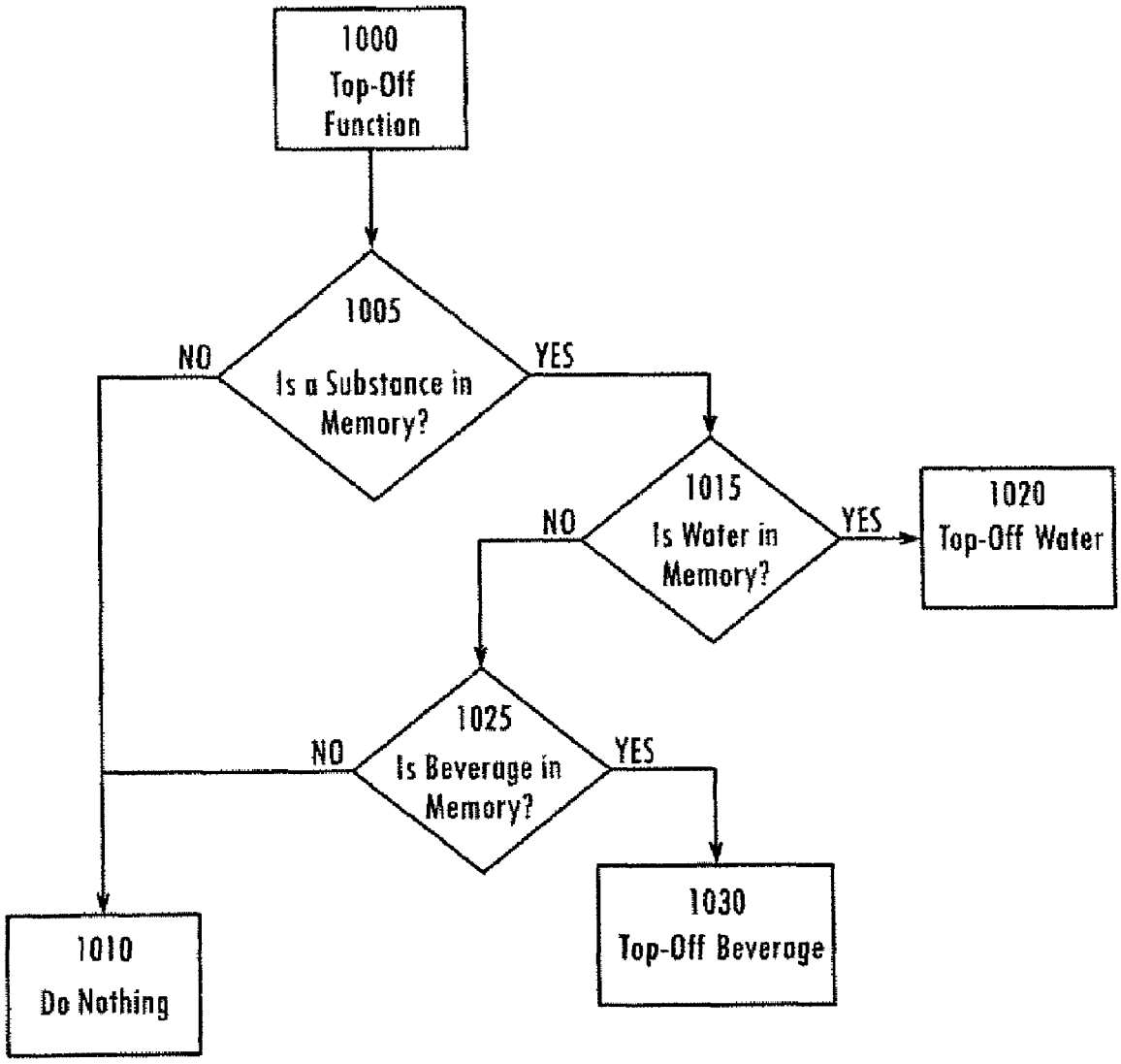
FIG. 10 is a flowchart of the control logic of a top-off function of a beverage tower, according to an illustrative embodiment of the present invention.

FIG. 10 is a flowchart of the programmed control logic 615 of a top-off function of a beverage tower 100, according to an illustrative embodiment of the present invention. The top-off key 775 may allow a user to fill a cup that was not completely filled by the initial dispensing of the beverage dispenser 100. The top-off key 775 may allow either water 110 or a blended beverage to be dispensed by the beverage tower 100 if either was the last substance dispensed by the beverage tower 100. If the top-off key 775 is selected, then the control unit 600 may verify that the top-off key 775 was pressed and enter the top-off function at step 1000. From step 1000, the control unit 600 may then go to step 1005. At step 1005, the control unit 600 may check its memory 605 in order to determine if either water 105 or a beverage was the last substance dispensed by the beverage tower 100. If, at step 1005, there is no last dispensed substance stored in the memory 605 of the control unit 600, then the control unit 600 may go to step 1010 and do nothing. If, however, there is a last dispensed substance stored in memory 605, which may be either a flavor shot, a beverage or water, then the control unit 600 may go to step 1015. At step 1015, the control unit 600 may determine whether or not the last dispensed substance stored in the memory 605 is water 110. If, at step 1015, the control unit 600 determines that the last dispensed substance is water 110, then the control unit 600 may go to step 1020 and top-off with water. If, however, at step 605, the last dispensed substance stored in the memory 605 is not determined to be water 110, then the control unit 600 may go to step 1025. At step 1025, the control unit 600 may determine whether or not the last dispensed substance was a beverage. If, at step 1025, the substance stored in the memory 605 of the control unit 600 as the last dispensed substance is a beverage, then the control unit 600 may go to step 1030. At step 1030, the control unit 600 may direct the beverage tower 100 to top-off with the stored beverage. If, however, at step 1025, the substance stored in the memory 605 is not determined to be a beverage, then the control unit 600 may go to step 1010 and do nothing. Accordingly, if the last dispensed substance is a flavor shot, then the control unit 600 will do nothing if the top-off key 775 is pressed because top-off is not allowed for a flavor shot. Additionally, if the control unit 600 directs the beverage tower 100 to top-off with either water 110 or a blended beverage, the maximum continuous dispensing time for the top-off dispense may be approximately 10 seconds. After approximately 10 seconds of continuous dispensing, the dispense may stop and the user may be required to reactivate the top-off key 775 to resume dispensing.

Figure 11:
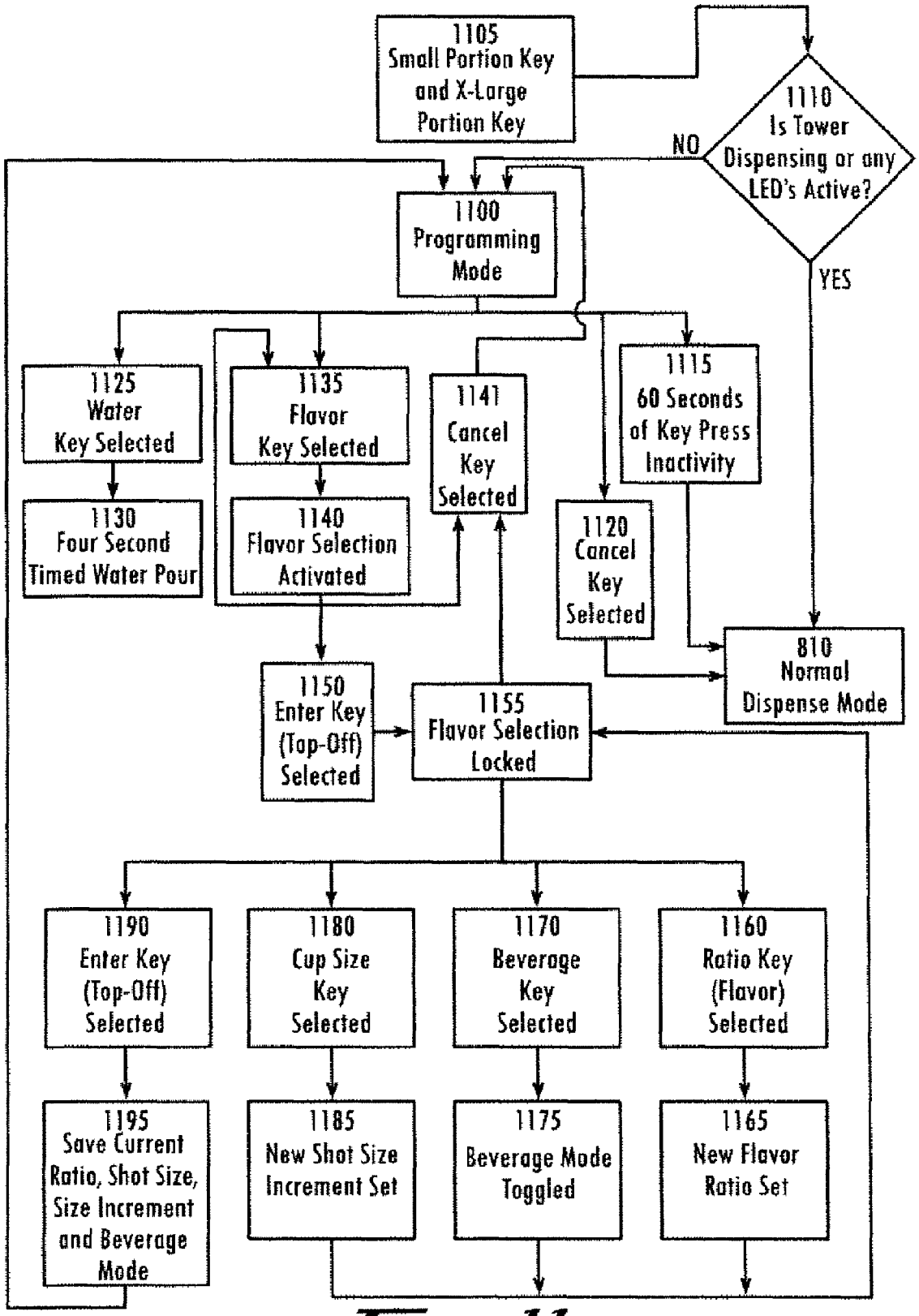
FIG. 11 is a flowchart of the control logic of a beverage tower operating in a programming mode, according to an embodiment of the present invention.

FIG. 11 is a flowchart of the programmed control logic 615 of a beverage tower 100 operating in a programming mode, according to an embodiment of the present invention. The programming mode may allow a user to change the shot size increment, ratio of a flavor syrup 105 to water 110 for a beverage, and/or to toggle the beverage lockout function for each flavor key 700 of the beverage tower 100. Accordingly, a user may customize the flavor syrup(s) 105 and beverages that are dispensed by the beverage tower 100. This flexibility may assist in permitting accommodation by the beverage tower 100 of a wide variety of flavor syrups 105 which may require different settings to achieve a desired flavor shot or beverage. Advantageously, the user interface panel 235 and/or the interface card 325 may be quickly exchanged or altered to reflect any programming or beverage/shot changes that are implemented.

In order to enter the programming mode, a user may be required to enter a particular sequence of keys. As shown in FIG. 11, one such sequence may be simultaneously selecting and holding the small cup size key 755 and the extra-large cup size key 770 for approximately two seconds. If, at step 1105, the small cup size key 755 and the extra-large cup size key 770 are selected and held for approximately two seconds, then the control unit 600 may go to step 1110. It will be understood that the control unit 600 may still enter its programming mode if the small cup size key 755 and the extra-large cup size key 770 are not pressed at exactly the same time. If the two keys 755, 770 are selected within a short time period, such as approximately 0.1 seconds, of one another, then the control unit 600 may still enter its programming mode. Alternatively, it will be understood that other predetermined key sequences may be utilized to activate the programming mode of the beverage tower 100.

At step 1110, the control unit 600 may check to determine whether the beverage tower 100 is actively dispensing a substance or whether any visual indicators 655 such as, for example, LED's are currently active. If, at step 1110 either of the above conditions are true, then the control unit 600 may not enter its program mode and may remain in or return to its normal dispense mode at step 810. Alternatively, if neither of the above conditions are determined to be true at step 1110, then the control unit 600 may go step 1100 and enter its programming mode 1100. Additionally, at step 1100, the visual indicators 655 associated with the enter key 775 and the cancel key 780 may be activated and may remain activated for the duration of the time in which the control unit 600 is in the programming mode. Additionally, while the control unit is at step 1100, it may periodically go to step 1115 and check for key press inactivity. If, at step 1115, the control unit 600 determines that no key has been pressed or selected in approximately the last 60 seconds, the control unit 600 may automatically return to its normal dispense mode at step 810. Additionally, if the cancel key 780 is selected while the control unit 600 is at step 1110, then the control unit 600 may return to its normal dispense mode at step 810.

When the control unit 600 is in the programming mode at step 1100, the control unit 600 may test for various key presses or selections that may be utilized in user programming of the beverage tower 100. If, at step 1100, the water key 750 is selected, then the control unit 600 may verify that the water key 750 was selected at step 1125 and then go to step 1130. At step 1130, the control unit 600 may direct the beverage tower 100 to dispense an approximately four second long timed pour of water 110. Additionally, at step 1130, the visual indicator 655 associated with the water key 750 may be illuminated for the duration of the timed water pour.

Alternatively, if at step 1100, a flavor key 700 is selected, then the control unit 600 may go to step 1135 and determine the flavor key 700 that was selected. Then the control unit 600 may go to step 1140 and the flavor selection may be activated. Additionally, at step 1140, the visual indicator 655 associated with the selected flavor key 700 may be illuminated. If, at step 1140, the cancel key 780 is selected, then the control unit 600 may go to step 1141 and verify the selection of the cancel key 780 and then return to step 1100. If; at step 1140, another flavor key 700 is selected, then the control unit 600 may go to step 1135 and verify the new flavor key 700 that was selected and then go back to step 1140. After returning to step 1140, the visual indicator 655 associated with the new flavor key 700 may be illuminated and the new flavor selection will be activated. If, at step 1140, the enter key 775 is selected, then the control unit 600 may go to step 1150 and verify that the enter key 775 was selected. From step 1150, the control unit 600 may go to step 1155 and the flavor selection may be locked. At step 1155, the visual indicators 655 associated with the current water to flavor syrup ratio setting and the current shot size increment for the selected flavor may blink continuously to indicate their current settings. Additionally, at step 1155, if the beverage mode or ability to dispense a blended beverage with the selected flavor is active, then the visual indicator 655 associated with the beverage key 745 may be continuously illuminated. If the selected flavor and its water to flavor syrup ratio setting require use of the same visual indicator 655, then a unique blinking rate of the visual indicator 655 may be displayed. It will be understood that virtually any unique blinking rate may be used such as, for example, two quick blinks followed by three long blinks.

If, at step 1155, the cancel key 780 is selected, then the control unit 600 may verify that the cancel key 780 was selected at step 1141 and then return to step 1100. Alternatively, at step 1155, new shot size increments, water to flavor syrup ratio settings, or beverage mode settings may be selected for the currently locked flavor selection. If, at step 780, a flavor key 700 is selected, then the control unit 600 may go to step 1160 and verify the flavor key 700 that was selected. Then, the control unit 600 may go to step 1165 and set a new flavor water to flavor syrup ratio for the locked in flavor selection. The water to syrup flavor ratio is the relative volumetric quantity of water to syrup in a blended beverage. More specifically, the first flavor key 705 may be used to select a 4:1 ratio; the second flavor key 710 may be used to select a 4.25:1 ratio; the third flavor key 715 may be used to select a 4.5:1 ratio; the fourth flavor key 720 may be used to select a 4.75:1 ratio; the fifth flavor key 725 may be used to select a 5:1 ratio, the sixth flavor key 730 may be used to select a 5.25:1 ratio; the seventh flavor key 735 may be used to select a 5.5:1 ratio; and the eight flavor key 740 may be used to select a 6:1 ratio.

Once a new water to flavor syrup ratio has been set at step 1165, the visual indicator 655 associated with the new water to flavor syrup ratio may blink continuously, the visual indicator 655 associated with the old water to flavor syrup ratio may be deactivated, and the control unit 600 may return to step 1155.

If, at step 1155, the beverage key 745 is selected, then the control unit 600 may go to step 1170 and verify that the beverage key 745 was selected. Then the control unit 600 may go to step 1175 and toggle the beverage mode for the locked flavor selection. In other words, the ability to dispense a blended beverage with the locked flavor selection may be toggled. If the visual indicator 655 associated with the beverage key 745 was activated, it may be deactivated and dispensing a beverage will be locked out for the flavor selection. Conversely, if the visual indicator 655 associated with the beverage key 745 was not activated, it will be activated and the beverage tower 100 will be permitted to dispense a blended beverage for the locked flavor selection. The control unit 600 may then return to step 1155.

If, at step 1155, a cup size key 702 is selected, then the control unit 600 may go to step 1180 and verify the cup size key 702 that was selected. Then the control unit 600 may go to step 1185. At step 1185, the control unit 600 may select a new shot size increment for the locked flavor selection. The shot size increment may determine the amount of flavor syrup 105 that will be dispensed for both a flavor shot and a blended beverage for the locked flavor selection. More specifically, the small cup size key 755 may be used for a ¼ ounce shot size increment; the medium cup size key 760 may be used for a ⅓ ounce shot size increment; the large cup size key 765 may be used for a ½ ounce shout size increment, and the extra-large cup size key 770 may be used for a ⅔ ounce shot size increment. Once a new shot size increment has been selected and set at step 1185, the visual indicator 655 associated with the new shot size increment may blink continuously, the visual indicator 655 associated with the old shot size increment may be deactivated, and the control unit 600 may return to step 1155.

If, at step 1155, the enter key 775 is selected, then the control unit 600 may go to step 1190 and verify that the enter key 775 was selected. Then the control unit 600 may go to step 1195. At step 1195, the current water to favor syrup ratio, shot size increment, and beverage mode setting may be saved to memory 605 for the locked flavor selection. Then the control unit 600 may return to its programming mode at step 1100.

It will be understood that changes in shot size increment or water to flavor syrup ratio for a beverage may correspond to changes in the settings for the valves of the flow control block 310. For example, if either of these two values is altered, it may be necessary to adjust the rate of flow for the associated flavor syrup 105 through its orifice or valve 405 in the flow control block 310. Alternatively, the amount of time that a solenoid 410 associated with the flavor syrup 105 is actuated may be altered. For example, if the solenoid 410 is actuated for a longer time interval, then more of the flavor syrup 105 may be permitted to pass through the solenoid 410 and the solenoid block 315 for dispense by the nozzle block 402.

According to another aspect of the present invention, the beverage tower 100 may include one or more default settings. The one or more default settings of the beverage tower 100 may define preprogrammed cup size, beverage lock out mode, and shot size increments for one or more of the flavor selections of the beverage tower. Additionally, the default settings may be programmed into the memory 605 of the control unit 600 of the beverage tower 100. As explained in greater detail below, the beverage tower 100 may be set or reset to a default setting by selecting a particular sequence of keys; however, it will be understood that the beverage tower 100 may be set to a default setting in a variety of ways such as, for example, providing one or more reset or default setting buttons on the beverage tower 100 or setting the beverage tower 100 to a default setting when power is no longer applied to the beverage tower 100.

Figure 12:
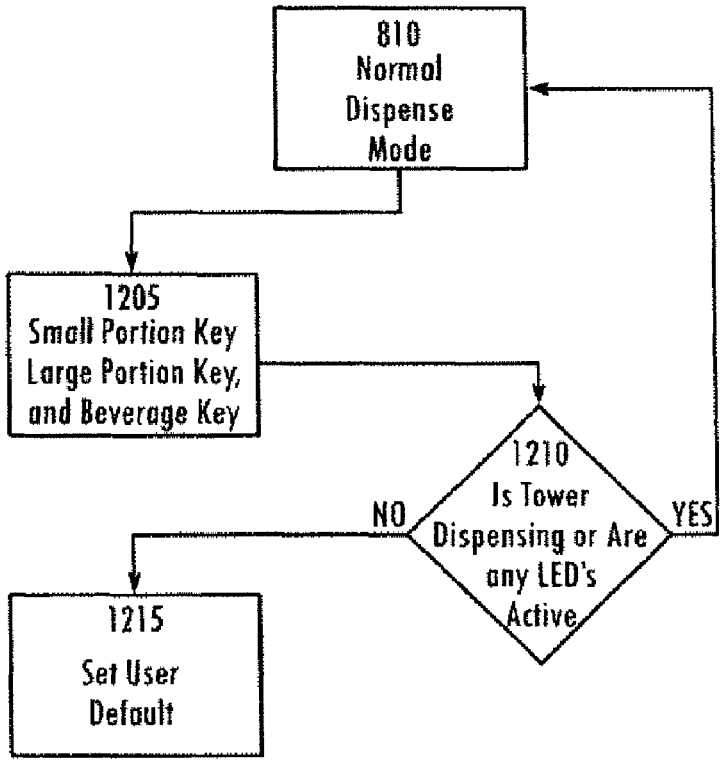
FIG. 12 is a flowchart of the control logic the beverage tower utilized to set the beverage tower to first default settings, according to an illustrative embodiment of the present invention.

FIG. 12 is a flowchart of the control logic the beverage tower 100 utilizes to set the beverage tower 100 to the first default settings, according to an illustrative embodiment of the present invention. The first default settings may include a preset water to flavor syrup ratio, shot size increment, and beverage lockout mode for each of the flavor keys 700 of the beverage tower 100. The beverage tower 100 may be returned to these default settings at any point during its operational lifetime, eliminating the need to personally keep track of the first default settings. To reset the beverage tower 100 to its first default settings, a user may simultaneously select and hold the small cup size key 755, the large cup size key 765, and the beverage key 745 for approximately two seconds while the beverage tower 100 and its control unit 600 are operating in their normal dispense mode. The simultaneous selection of the above identified keys may cause the control unit 600 to enter step 1205. It will be understood that the control unit 600 may still enter step 1205 even if the three required keys are not pressed or selected simultaneously. For example, if the three required keys are selected within a short time period, such as approximately 0.1 seconds, of one another and then held for approximately two seconds, then the control unit 600 may enter step 1205. Alternatively, other predetermined key sequences may be utilized to activate the first default settings. Once the control unit 600 enters step 1205, it may go to step 1210 and determine whether or not the beverage tower 100 is actively dispensing a substance or whether any visual indicators 655 of the interface and control cassette 320 are actuated. If, at step 1210, either of the above referenced conditions are determined to be true, then the control unit 600 may not set the first default settings and the control unit 600 may return to step 810. However, if at step 1210, neither of the above referenced conditions are determined to be true, then the control unit 600 may go to step 1215 and set the first default settings, which are described in greater detail below with reference to FIG. 14A.

Figure 13:
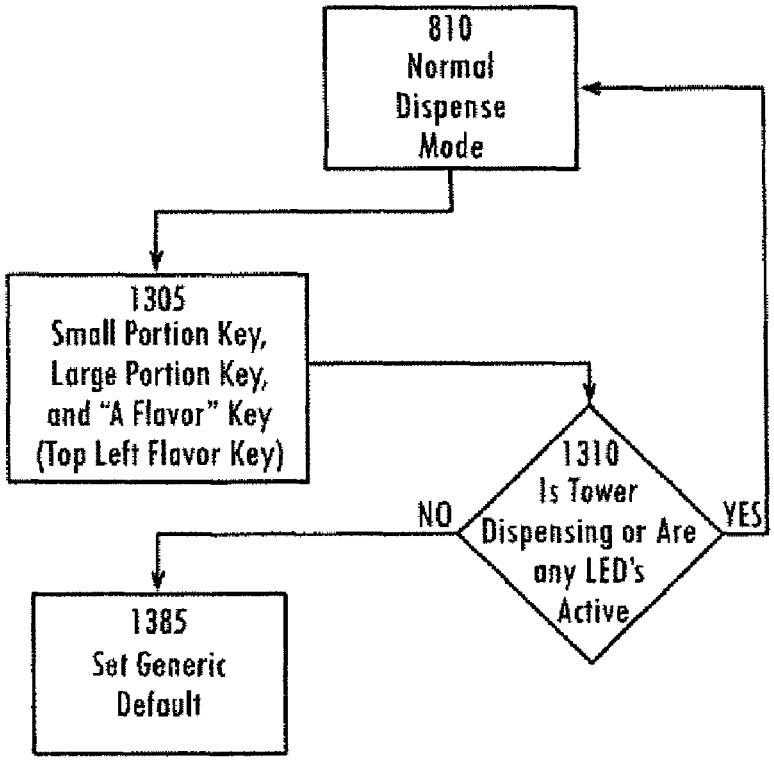
FIG. 13 is a flowchart of the control logic the beverage tower utilized to set the beverage tower to second default settings, according to an illustrative embodiment of the present invention.

FIG. 13 is a flowchart of the control logic the beverage tower 100 utilizes to set the beverage tower 100 to second default settings, according to an illustrative embodiment of the present invention. The second default settings may include a preset water to flavor syrup ratio, shot size increment, and beverage lockout mode for each of the flavor keys 700 of the beverage tower 100. The beverage tower 100 may be returned to these second default settings at any point during its operational lifetime, eliminating the need to personally keep track of the second default settings. To reset the beverage tower 100 to its second default settings, a user may simultaneously select and hold the small cup size key 755, the large cup size key 765, and the first flavor key 705 for approximately two seconds while the beverage tower 100 and its control unit 600 are operating in their normal dispense mode. The simultaneous selection of the above identified keys may cause the control unit 600 to enter step 1305. It will be understood that the control unit 600 may still enter step 1305 even if the three required keys are not pressed or selected simultaneously. For example, if the three required keys are selected within a short time period, such as approximately 0.1 seconds of one another and then held for approximately two seconds, then the control unit 600 may enter step 1305. Alternatively, other predetermined key sequences may be utilized to activate the second default settings. Once the control unit 600 enters step 1305, it may go to step 1310 and determine whether or not the beverage tower 100 is actively dispensing a substance or whether any visual indicators 655 of the interface and control cassette 320 are actuated. If, at step 1310, either of the above referenced conditions are determined to be true, then the control unit 600 may not set the second default settings and the control unit 600 may return to step 810. However, if at step 1310, neither of the above referenced conditions are determined to be true, then the control unit 600 may go to step 1315 and set the second default settings, which are described in greater detail below with reference to FIG. 14B.

It will be understood by those of skill in the art that the steps performed by the control unit 600 with reference to FIGS. 8-13 do not necessarily have to be performed in the order set forth in the logic of FIGS. 8-13, but instead may be performed in any suitable order. It will also be understood that the control unit 600 may perform more or less than the steps set forth in FIGS. 8-13 during the normal operation of the present invention.

FIGS. 14A-B are tables depicting the characteristics of the first and second default setting of a beverage tower 100, according to an illustrative embodiment of the present invention. FIG. 14A depicts an example of the first default settings of the beverage tower 100. Similarly, FIG. 14B depicts an example of the second default settings of the beverage tower 100. In both FIG. 14A and FIG. 14B, default water to flavor syrup ratios, shot size increments, and beverage lockout modes are provided for each flavor key 700 of the interface card 325 of the beverage tower 100.

According to an aspect of the present invention, during flavor shot or beverage dispense, the control unit 600 may communicate or transmit a control signal to the solenoid block 315, causing the solenoid 410 associated with the desired flavor syrup 105 to be actuated. When the solenoid 410 is actuated, the flavor syrup 105 may be permitted to pass through the solenoid 410 for dispense by the nozzle block 402. The solenoid 410 may remain actuated for a certain period of time determined by the volume of flavor syrup 105 necessary for a desired flavor shot or blended beverage. FIGS. 15A-E are tables depicting lengths of time that a solenoid 410 needs to remain open in order to dispense a flavor shot or blended beverage from the beverage tower 100 for various cup sizes and ratios of water to flavor syrup, according to an illustrative embodiment of the present invention. FIG. 15A is a table depicting the lengths of time that a solenoid 410 needs to remain open in order to dispense a blended beverage for various cup sizes and water to flavor syrup ratios. Similarly, FIG. 15B is a table depicting the lengths of time that a solenoid 410 needs to remain open in order to dispense a flavor shot having a ¼ ounce shot size increment for various cup sizes and water to flavor syrup ratios. FIG. 15C is a table depicting the lengths of time that a solenoid 410 needs to remain open in order to dispense a flavor shot having a ⅓ ounce shot size increment for various cup sizes and water to flavor syrup ratios. FIG. 15D is a table depicting the lengths of time that a solenoid 410 needs to remain open in order to dispense a flavor shot having a ½ ounce shot size increment for various cup sizes and water to flavor syrup ratios. FIG. 15E is a table depicting the lengths of time that a solenoid 410 needs to remain open in order to dispense a flavor shot having a ⅔ ounce shot size increment for various cup sizes and water to flavor syrup ratios.

According to another aspect of the present invention, the memory 605 of the control unit 600 may be utilized to store historical data associated with the beverage tower 100. Historical data may include any data associated with the historical use of the beverage tower 100 such as, for example, the time of use or operational time of the beverage tower 100, the number of and/or time of beverage selections and flavor shot selections that have been made, the number of top-off key selections, the number of cancel key selections, the number of times that the beverage tower 100 has been reprogrammed, and the number of times that the beverage tower 100 has been reset to a default setting. The historical data may additionally be retrieved from the memory 605 of the control unit 600 by a user of the beverage tower 100. The historical data may be retrieved by a user in a variety of ways such as, for example, by display of the historical data to the user via the user interface panel 235. The historical data may also be transmitted by the beverage tower 100 over a network such as, for example, the Internet. The historical data may also be communicated by the beverage tower 100 from the memory 605 to a separate electronic storage device such as, for example, a zip drive, portable hard drive, or floppy disk.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A beverage dispenser, comprising:

a flow control module that is configured to be coupled to a plurality of incoming supply lines carrying water and at least one beverage additive, and wherein the flow control module provides individual channels through which the water and beverage additive pass at a controlled flow rate;

a switch module configured to receive the water and beverage additive from the flow control module, wherein the switch module provides individual channels through which the water and beverage additive respectively pass, the switch module comprising a switch associated with each of the channels through which the water and beverage additive pass that may be selectively actuated to individually control the flow of the water and beverage additive through the switch module;

a nozzle configured to receive the water and beverage additive downstream from the switch module and providing individual channels through which the water and beverage additive are dispensed;

a control panel configured to receive user input for a beverage additive selection and a request to dispense a blended beverage including the selected beverage additive; and a control unit coupled to the control panel and the switch module, wherein the control unit is configured (i) to determine whether a blended beverage dispense is permitted for the selected beverage additive, (ii) to direct, if it is determined that the blended beverage dispense is permitted, the dispense of the blended beverage including the selected beverage additive by selectively actuating a group of switches associated with the water and the selected beverage additive, and (iii) to disallow, if it is determined that the blended beverage dispense is not permitted for the selected beverage additive, the dispense of a blended beverage while permitting a subsequent dispense of a controlled amount of the selected beverage additive by selectively actuating at least one switch associated with the selected beverage additive.

2. The beverage dispenser of claim 1, wherein the control panel is further configured to receive a size selection from the user.

3. The beverage dispenser of claim 1, wherein the switch module is comprised of a unitary block defining the individual channels and configured for securely coupling to the switch associated with each of the individual channels.

4. The beverage dispenser of claim 1, wherein the control panel includes a removable selection card, wherein the removable selection card depicts one or more user input options.

5. The beverage dispenser of claim 4, wherein the removable selection card comprises a mylar card.

6. The beverage dispenser of claim 1, wherein the nozzle comprises a plurality of injectors configured to dispense the beverage additive received by the nozzle, wherein each of the plurality of injectors comprises a respective mouth formed in a concave manner extending upwardly into the injector.

7. The beverage dispenser of claim 1, wherein the nozzle further comprises:

a plurality of dispensers; and a nozzle cap configured to direct the flow of water dispensed from said dispensers such that the dispensed water mixes with a beverage additive dispensed by the nozzle at a point below the nozzle in order to form a blended beverage.

8. The beverage dispenser of claim 7, wherein the brix ratio of a blended beverage dispensed by the beverage dispenser does not vary by more than approximately one degree throughout the blended beverage.

9. The beverage dispenser of claim 1, wherein the control panel comprises a plurality of coupling capacitor sensing elements configured to receive the user input.

10. The beverage dispenser of claim 1, wherein the user input is received by the control panel without the user making physical contact with the control panel.

11. The beverage dispenser of claim 2, wherein the control unit further comprises a memory configured to store a plurality of beverage additive shot sizes and a plurality of ratios associated with the different size selections provided by the control panel, wherein the plurality of ratios define respective amounts of beverage additive to be mixed with a predetermined amount of water for a plurality of blended beverage dispensed by the beverage dispenser.

12. The beverage dispenser of claim 11, wherein the control panel is further configured to receive user input for reprogramming one or more beverage additive shot sizes and ratios that are stored in the memory.

13. The beverage dispenser of claim 1, wherein the control unit further comprises a memory configured to store information associated with a plurality of beverage additives and an indication as to whether a blended beverage dispense is permitted for each of the plurality of beverage additives.

14. The beverage dispenser of claim 13, wherein the memory includes historical data relating to the use of the beverage dispenser.

15. The beverage dispenser of claim 11, wherein the memory further comprises default settings that define flavor shot sizes and ratios of a plurality of flavor shots and blended beverages.

16. The beverage dispenser of claim 14, wherein:

the control panel is further configured to receive a user selection of a top off selection, and the control unit is further configured (i) to access the historical data stored in the memory, (ii) to determine whether a last dispense was for a blended beverage or for a controlled amount of beverage additive, (iii) to direct, if it is determined that the last dispense was for a blended beverage, the dispense of an additional amount of the blended beverage, or (iii) to prevent, if it is determined that the last dispense was for a controlled amount of beverage additive, the dispense of an additional amount of the beverage additive.

17. A method for dispensing beverage additives and beverages comprising:

receiving water and at least one beverage additive from a plurality of incoming supply lines;

controlling the flow of the received water and beverage additive with a respective flow rate device and individually actuatable switch associated with each incoming supply line;

receiving user input comprising a beverage additive selection and a request to dispense a blended beverage including the selected beverage additive;

determining, by a computing device, whether a blended beverage dispense is permitted for the selected beverage additive;

dispensing, if it is determined that the blended beverage dispense is permitted, predetermined amounts of the water and the selected beverage additive by selectively actuating a group of switches associated with the water and the selected beverage additive; and disallowing, if it is determined that the blended beverage dispense is not permitted for the selected beverage additive, the dispense of a blended beverage while permitting a subsequent dispense of a predetermined amount of the selected beverage additive by selectively actuating at least one switch associated with the selected beverage additive.

18. The method of claim 17, wherein receiving user input further comprises receiving a size selection.

19. The method of claim 17, wherein receiving user input comprises receiving user input based on a removable selection card, wherein the removable selection card depicts one or more user input options.

20. The method of claim 17, wherein the beverage additive is dispensed from a nozzle that comprises a plurality of injectors configured to dispense the beverage additive received by the nozzle, wherein each of the plurality of injectors comprises a respective mouth formed in a concave manner extending upwardly into the injector.

21. The method of claim 17, wherein directing the dispense of a predetermined amount of the water further comprises:

directing the flow of dispensed water such that the dispensed predetermined amount of the water mixes with the predetermined amount of the selected beverage additive dispensed by the nozzle at a point below the nozzle in order to form a blended beverage.

22. The method of claim 17, wherein the user input comprises a first user input, and further comprising:

storing, in a memory device, historical data associated with a last dispense;

receiving, second user input comprising a top off selection;

accessing, by the computing device, the stored historical data associated with the last dispense;

determining, by the computing device, whether the last dispense was for a blended beverage or for a predetermined amount of beverage additive;

dispensing, if it is determined that the last dispense was for a blended beverage, an additional amount of the blended beverage, and preventing, if it is determined that the last dispense was for a predetermined amount of beverage additive, the dispense of an additional amount of the beverage additive.

* * * * *